US007073880B2

(12) United States Patent
Takahashi et al.

(10) Patent No.: US 7,073,880 B2
(45) Date of Patent: Jul. 11, 2006

(54) INK JET PRINTING APPARATUS AND METHOD USING REMOVABLY MOUNTED PRINT MEDIUM TRAY

(75) Inventors: Seiji Takahashi, Kanagawa (JP); Kenji Kawazoe, Kanagawa (JP); Haruyuki Yanagi, Tokyo (JP); Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 10/649,872

(22) Filed: Aug. 28, 2003

(65) Prior Publication Data

US 2004/0041853 A1 Mar. 4, 2004

(30) Foreign Application Priority Data

Aug. 30, 2002 (JP) ..... 2002-255902

(51) Int. Cl.
*B41J 29/38* (2006.01)

(52) U.S. Cl. ..... 347/16

(58) Field of Classification Search ..... 347/152, 347/16, 19, 101, 155, 220, 187, 2, 4, 104; 400/23, 29, 30, 48, 55; 349/16, 29, 361; 346/16

See application file for complete search history.

(56) References Cited

U.S. PATENT DOCUMENTS 5,188,351 A * 2/1993 Gysling ..... 271/171
5,746,528 A * 5/1998 Mayer et al. ..... 400/625
5,828,818 A * 10/1998 Anzai ..... 358/1.18
5,975,515 A * 11/1999 Capri et al. ..... 271/9.11
6,004,062 A * 12/1999 Hunter et al. ..... 402/79
6,059,282 A * 5/2000 Jang ..... 271/160
6,250,735 B1 * 6/2001 Kaneko et al. ..... 347/19
6,312,174 B1 * 11/2001 Drynkin et al. ..... 400/120.16
6,317,145 B1 * 11/2001 Myung ..... 346/16
6,580,444 B1 * 6/2003 Drynkin et al. ..... 347/171
6,631,985 B1 10/2003 Koizumi et al.
6,760,052 B1 * 7/2004 Cummins et al. ..... 347/171
2002/0057302 A1 * 5/2002 Shimomura et al. ..... 347/8
2002/0067940 A1 * 6/2002 Sasai et al. ..... 400/61

FOREIGN PATENT DOCUMENTS

| | | |
|---|---|---|
| EP | 1 190 857 | 3/2002 |
| JP | 62-9971 | 1/1987 |
| JP | 9-295412 | 11/1997 |
| JP | 10-250051 | 9/1998 |
| JP | 2000-58735 | 2/2000 |
| JP | 2000-229405 | 8/2000 |
| JP | 2001-58735 | 3/2001 |
| JP | 2001-138592 | 5/2001 |

(Continued)

*Primary Examiner*—K. Feggins
*Assistant Examiner*—Rene Garcia, Jr.
(74) *Attorney, Agent, or Firm*—Fitzpatrick, Cella, Harper & Scinto

(57) ABSTRACT

This invention is intended to perform a mounting/dismounting or replacement of a print head and ink tank mounted on the carriage without contaminating a print medium including a tray when performing an ink jet printing using the tray. For this purpose, the tray guide that supports the tray so that it can be fed is removably mounted to the printing apparatus. Whether this tray guide is mounted to the printing apparatus is detected by the tray guide sensor. According to a result of detection by this tray guide sensor, the control unit for controlling the driving of the carriage controls the position of the carriage in the main scan direction.

6 Claims, 26 Drawing Sheets

FOREIGN PATENT DOCUMENTS * cited by examiner

WO WO 99/52713 10/1999

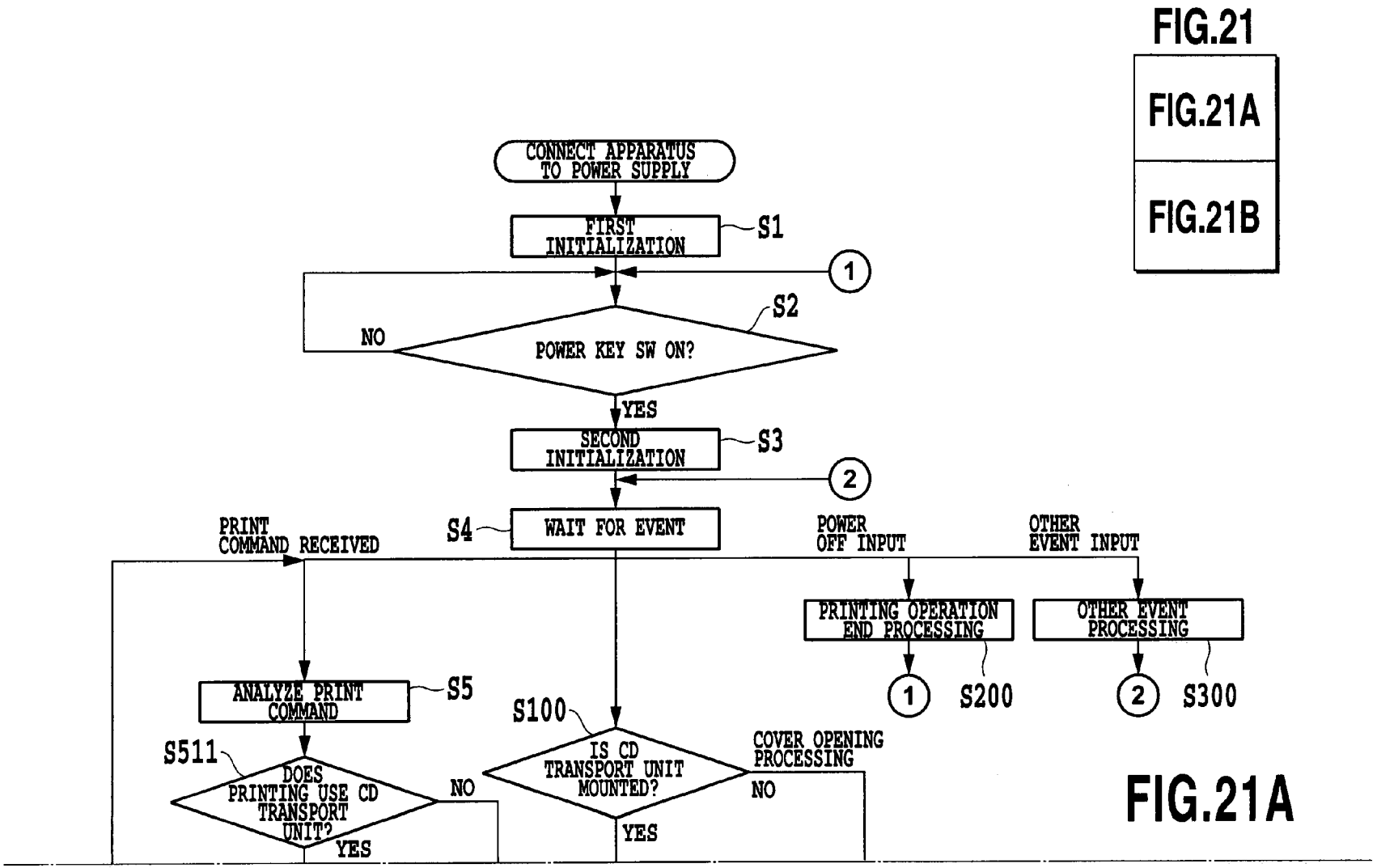
FIG.21
FIG.21A
FIG.21B
CONNECT APPARATUS TO POWER SUPPLY
S1
FIRST INITIALIZATION
S2
POWER KEY SW ON?
YES
NO
S3
SECOND INITIALIZATION
S4
WAIT FOR EVENT
POWER OFF INPUT
OTHER EVENT INPUT
PRINT COMMAND RECEIVED
PRINTING OPERATION END PROCESSING
S200
OTHER EVENT PROCESSING
S300
S5
ANALYZE PRINT COMMAND
S511
DOES PRINTING USE CD TRANSPORT UNIT?
S100
IS CD TRANSPORT UNIT MOUNTED?
COVER OPENING PROCESSING
1
2
FIG.21A

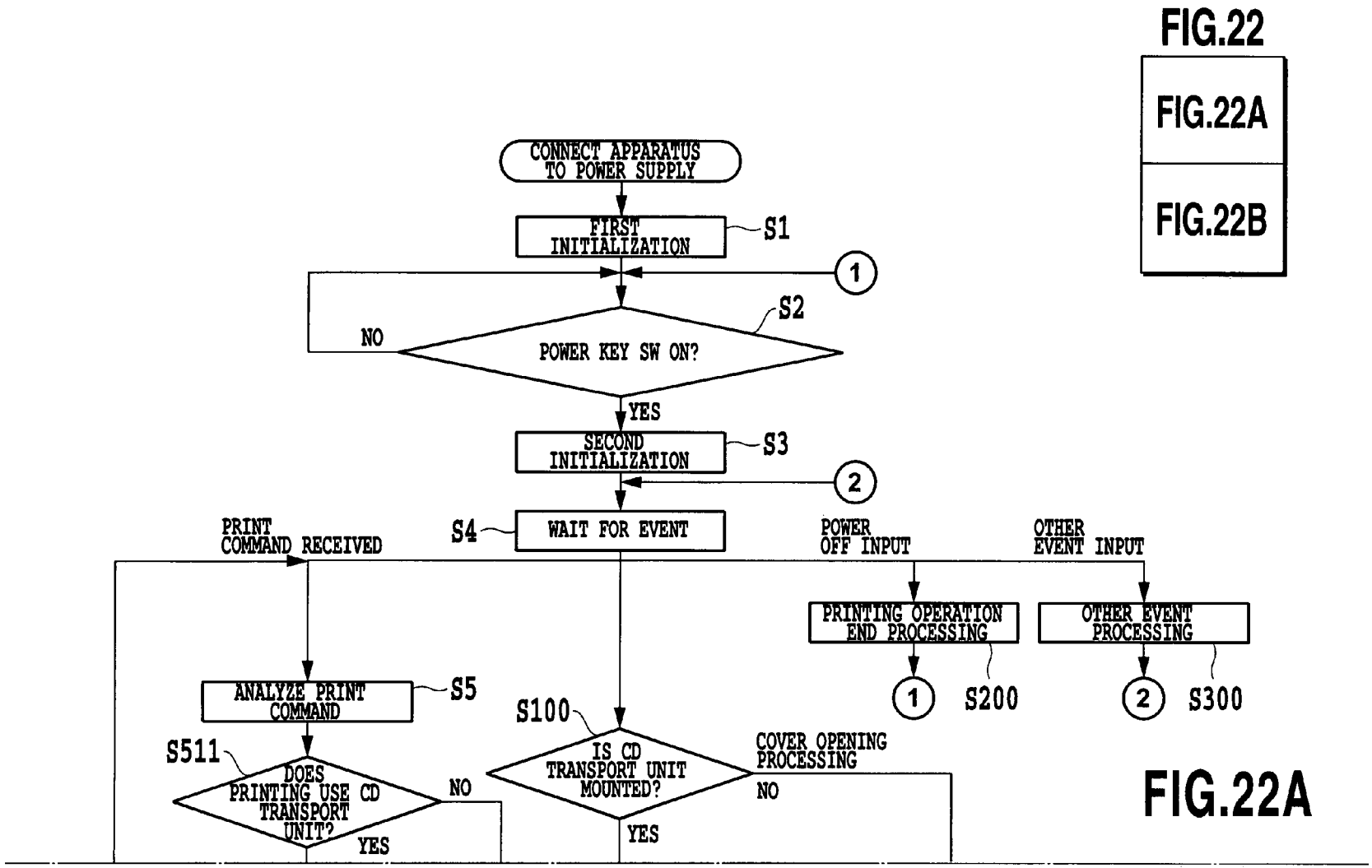
FIG.22
FIG.22A
FIG.22B
CONNECT APPARATUS TO POWER SUPPLY
S1
FIRST INITIALIZATION
S2
POWER KEY SW ON?
YES
NO
1
S3
SECOND INITIALIZATION
2
S4
WAIT FOR EVENT
POWER OFF INPUT
OTHER EVENT INPUT
PRINTING OPERATION END PROCESSING
S200
1
OTHER EVENT PROCESSING
S300
2
PRINT COMMAND RECEIVED
S5
ANALYZE PRINT COMMAND
S511
DOES PRINTING USE CD TRANSPORT UNIT?
NO
YES
S100
IS CD TRANSPORT UNIT MOUNTED?
NO
YES
COVER OPENING PROCESSING
FIG.22A

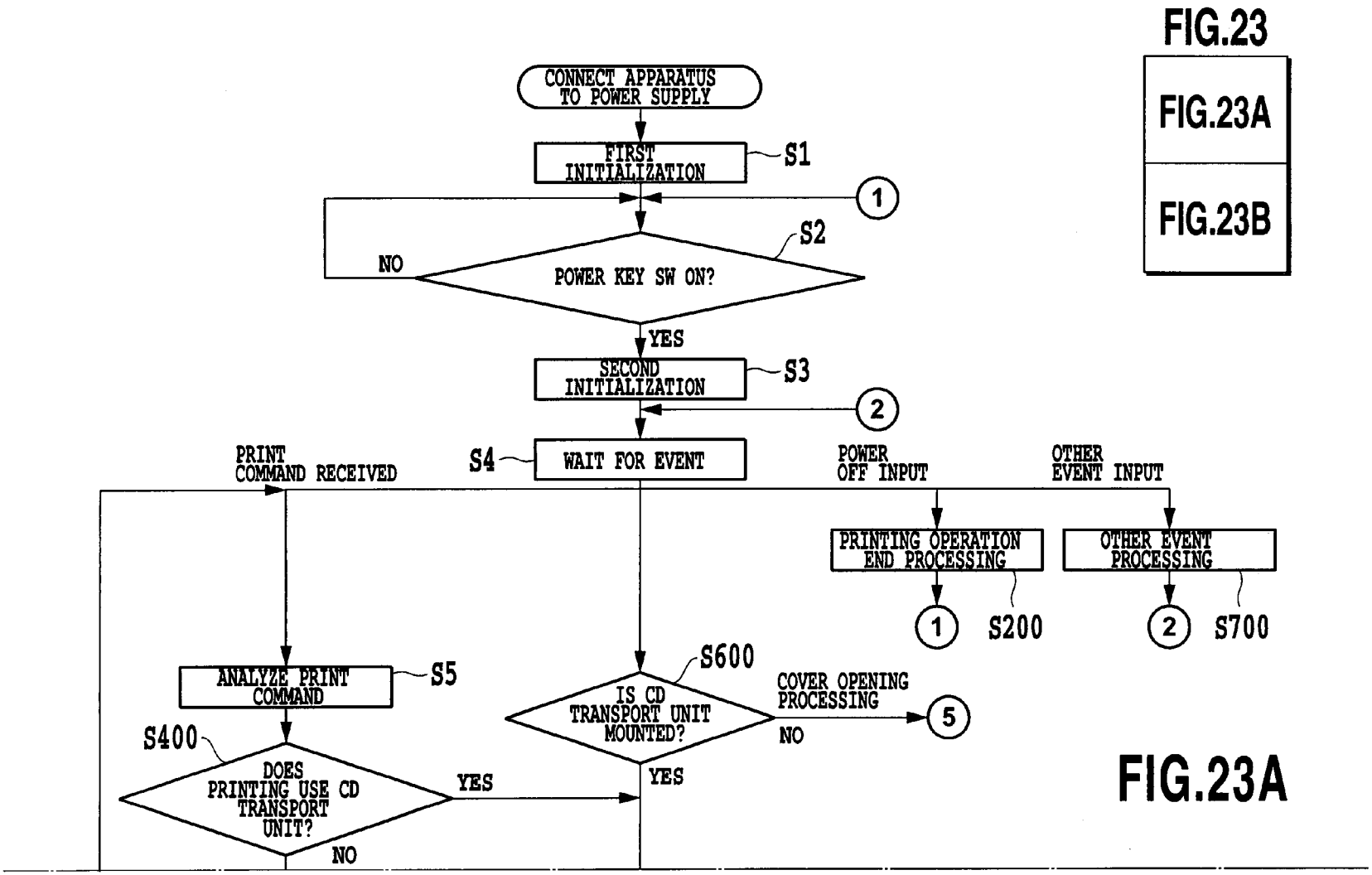
FIG.23
FIG.23A
FIG.23B
CONNECT APPARATUS TO POWER SUPPLY
S1
FIRST INITIALIZATION
1
S2
POWER KEY SW ON?
NO
YES
S3
SECOND INITIALIZATION
2
S4
WAIT FOR EVENT
POWER OFF INPUT
OTHER EVENT INPUT
PRINTING OPERATION END PROCESSING
S200
1
OTHER EVENT PROCESSING
S700
2
PRINT COMMAND RECEIVED
S5
ANALYZE PRINT COMMAND
S400
DOES PRINTING USE CD TRANSPORT UNIT?
YES
NO
S600
IS CD TRANSPORT UNIT MOUNTED?
YES
NO
COVER OPENING PROCESSING
5
FIG.23A

INK JET PRINTING APPARATUS AND METHOD USING REMOVABLY MOUNTED PRINT MEDIUM TRAY

This application claims priority from Japanese Patent Application No. 2002-255902 filed Aug. 30, 2002, which is incorporated hereinto by reference.

BACKGROUND OF THE INVENTION

1. Field of the Invention

The present invention relates to a printing apparatus that forms an image by reciprocating a carriage mounting a print head and more particularly to an ink jet printing apparatus and an ink jet printing method capable of using a relatively thick print material such as a tray accommodating a compact disc.

2. Description of the Related Art

Ink jet printing apparatus are currently being applied not only to rectangular sheets of paper or strips of rolled paper but also to other print materials having a variety of two-dimensional shapes and thicknesses. For example, even small and thick materials, such as CD-Rs, DVDs and cards, are printed with various images and characters by putting on their surfaces a print material suited for ink jet printing and printing images and characters (in the following, these materials to be printed on are generally called compact discs (CDs)).

In conventional general-purpose ink jet printing apparatus, when a material such as a CD is to be printed, if a general transport path for paper is used, various problems will arise, including bad feeding performance because of its high stiffness, the CD sustaining scores, and the CD failing to be transported because of a relatively long distance between feed rollers. To deal with these problems, the conventional apparatus use a dedicated path for a tray different from the general paper transport path.

Since trays have a greater thickness than that of general paper, the tray transport path is set almost horizontal and, from a standpoint of user's maneuverability, often configured to accept a tray from a front side of the printing apparatus as opposed to a back side from which paper is usually loaded. In this configuration, whether the tray is loaded in the transport path is usually not directly detected by a sensor. This is because the use of a configuration that enables detection of the presence or absence of a tray loaded from the opposite direction makes a reduction in size and cost of the apparatus difficult.

Meanwhile, in ink jet printing apparatus capable of printing such materials as CDs, an ink jet printing method that performs printing by scanning an ink ejecting print head mounted on a carriage along with the carriage is widely adopted. Thanks to many advantages, such as an ease with which an image can be formed in colors and at an increased resolution and low operation noise, the ink jet printing apparatus are in widespread use.

Many ink jet printing apparatus have a print head and an ink tank removably and replaceably mounted on a carriage. In this configuration, when the print head and ink tank are to be removed or replaced, the user opens a cover member of the printing apparatus, automatically causing the carriage to move to a predetermined position for replacement. In some printing apparatus, an opening formed at this replacement position is provided in a housing case. The position where the carriage is dismounted or replaced is often located on a transport path of a print medium such as paper or a tray.

The ink jet printing apparatus generally perform cleaning processing that makes a print head fit for ink ejection operation. The cleaning processing includes a suction operation that sucks out from the print head ink which is unfit for printing due to progressive degradation over time, a preliminary ink ejection operation for a similar purpose, and a wiping operation that wipes ink off an ink ejection portion of the print head. Some apparatus also perform an ink volume check as part of the cleaning processing before starting the printing operation by installing an ink tank sensor to detect a volume of ink in the ink tank.

These cleaning processing operations for the print head are performed either by the user manually requesting the cleaning through the printing apparatus or automatically by the printing apparatus according to a time that has passed from the previous cleaning operation. Of the apparatus that perform the cleaning operation automatically, some execute the cleaning operation prior to the printing operation immediately after the apparatus receives a print command.

These conventional techniques, however, have the following drawbacks.

(1) Of those printing apparatus that print on a print medium, such as a CD placed on a tray loaded into a transport path, some employ a construction in which the tray is loaded from a direction opposite to that in which paper is loaded. In this case, if it is checked not only whether paper is loaded but also whether a tray is loaded, sensors to detect the paper and tray separately must be provided in the printing apparatus. Not only does this make the sensor arrangement difficult but it also hinders a size reduction of the apparatus. Thus, in practice, it is often the case that a detection is not made as to whether the tray is loaded in the transport path. In a configuration that does not use a tray detection means, it is common practice to removably mount on the printing apparatus a member for guiding and supporting the tray as it is loaded into the printing apparatus (in this example, the member is described as a CD transport unit) and check whether this member is mounted on the apparatus. In this configuration, however, whether the tray is loaded in an appropriate position in the apparatus may not be able to be detected correctly. Thus, when a tray is loaded in the printing apparatus, the tray may be set very close to a carriage in the apparatus depending on the loaded position of the tray. Therefore, when a print head and an ink tank mounted on the carriage are to be removed or replaced by moving the carriage to a position opposing the transport path loaded with a CD mounting tray, ink adhering to the print head or carriage may come into contact with and contaminate a print medium such as the CD or its tray.

(2) To solve the above problem, a carriage setting position (replacement position) where a print head and an ink tank are replaced may be set outside the transport path of the print medium including CD and tray. However, the transport path is generally provided almost at a center of the printing apparatus with respect to a carriage scan direction. Therefore, to set the replacement position outside the transport path requires forming an opening at an end portion of the equipment case. This reduces the strength of the case, giving rise to another problem.

(3) Further, as described in (1) above, the configuration that does not detect the loading of a print medium, such as a CD mounting tray, into the transport path has a drawback that, during the cleaning operation performed prior to the printing operation, if the carriage moves across the print medium transport path, ink adhering to the print head and carriage may contact and contaminate a print medium, such as CD and tray.

SUMMARY OF THE INVENTION

The present invention can provide a reliable printing apparatus of a small and low-cost construction that can perform a mounting/dismounting or replacement of a print head and ink tank mounted on the carriage without contaminating a print medium including a tray when performing a printing using the tray.

In a first aspect, the present invention provides a printing apparatus for printing on a print medium with a print head, comprising: a tray on which to put the print medium; a tray guide removably mounted to the printing apparatus to support the tray so that it can be fed; detecting means for detecting whether or not the tray guide is mounted to the printing apparatus; and control means for controlling the printing apparatus; wherein the control means changes its control on the printing apparatus according to a result of the detection by the detecting means.

In a second aspect, the present invention provides a printing method for printing on a print medium with a print head, comprising the steps of: removably mounting to a printing apparatus a tray guide that supports a tray on which the print medium is placed so that the tray can be fed; detecting whether or not the tray guide is mounted to the printing apparatus by detecting means; and changing a control on the printing apparatus by the control means according to a result of the detection by the detecting means.

With this invention, since the tray support means that supports the tray loaded with a print medium in such a manner that the tray can be transported is removably mounted to the printing apparatus and since it is detected whether the tray support means is mounted to the printing apparatus and the driving of the printing apparatus is controlled according to a result of the detection, it is possible to obtain an appropriate printing result with a small and inexpensive construction, without contaminating the print medium including the tray. Thus, when mounting/dismounting or replacing the print head or ink tank, the tray can be protected against being smeared with ink. Further, when moving the carriage for print head nozzle cleaning prior to the printing operation, a contact between the tray and the carriage can be avoided, allowing for an appropriate printing with high reliability without causing damage or contamination to the print medium including the tray.

The above and other objects, effects, features and advantages of the present invention will become more apparent from the following description of embodiments thereof taken in conjunction with the accompanying drawings.

BRIEF DESCRIPTION OF THE DRAWINGS

FIG. 21 is a diagram showing the relationship of FIGS. 21A and 21B;

FIGS. 21A and 21B comprise a flow chart showing a control sequence of the ink jet printing apparatus in the first embodiment of the invention;

FIG. 22 is a diagram showing the relationship of FIGS. 22A and 22B;

FIGS. 22A and 22B comprise a flow chart showing a control sequence of the ink jet printing apparatus in a second embodiment of the invention;

FIG. 23 is a diagram showing the relationship of FIGS. 23A and 23B; and FIGS. 23A and 23B comprise a flow chart showing a control sequence of the ink jet printing apparatus in a third embodiment of the invention.

DETAILED DESCRIPTION OF PREFERRED EMBODIMENTS

FIRST EMBODIMENT

Figure 1:
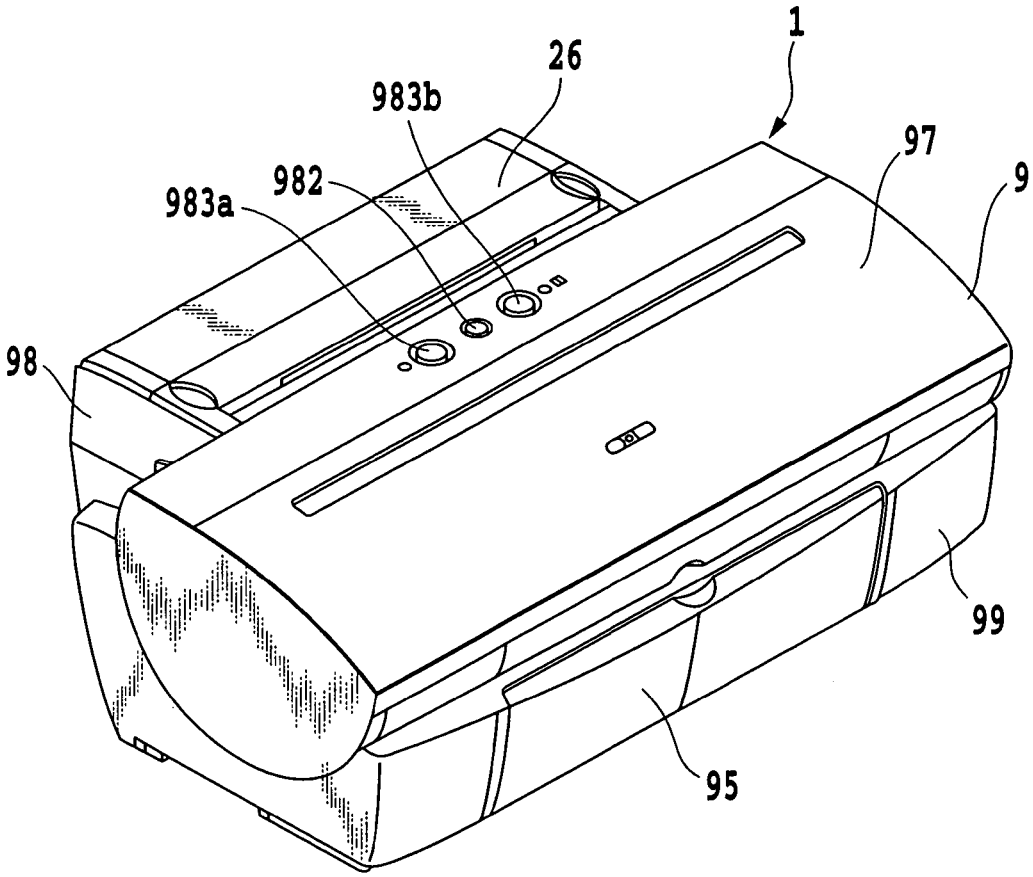
FIG. 1 is a perspective view of an ink jet printing apparatus as a first embodiment of the present invention.
Figure 2:
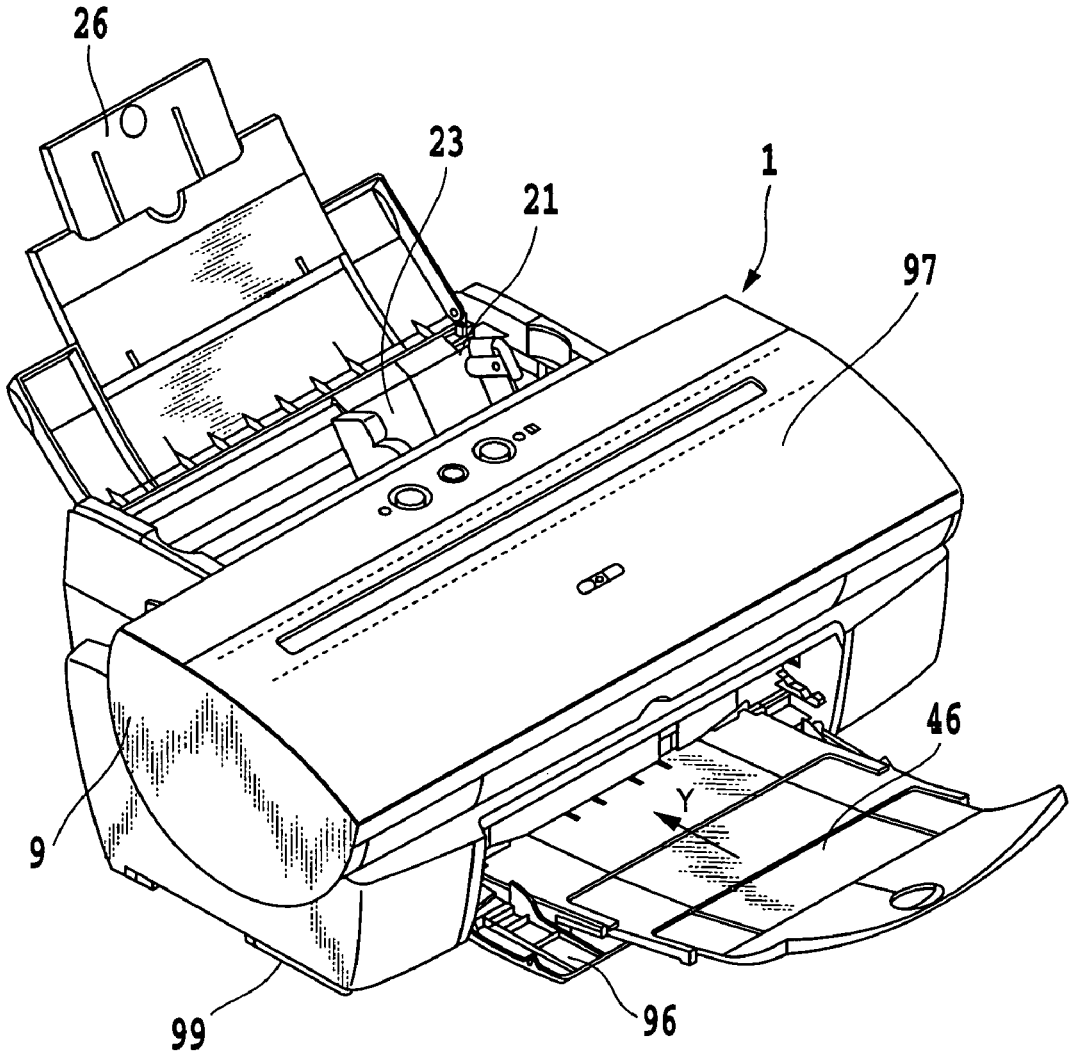
FIG. 2 is a perspective view of the first embodiment of the ink jet printing apparatus, with a front cover and a paper supply tray open from the state of FIG. 1.
Figure 3:
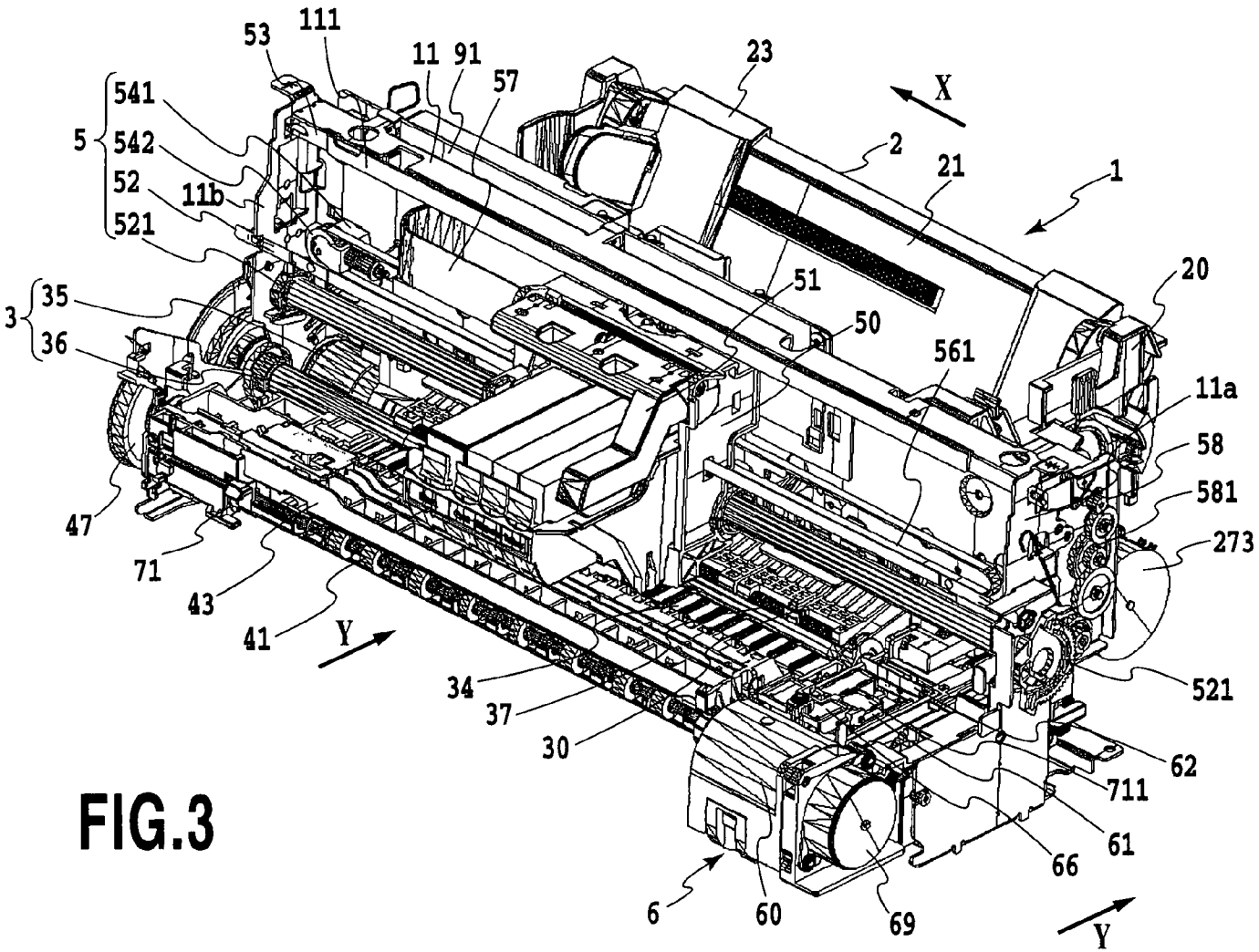
FIG. 3 is a perspective view of the first embodiment of the ink jet printing apparatus, showing a mechanical construction as seen from diagonally above on the right side.
Figure 4:
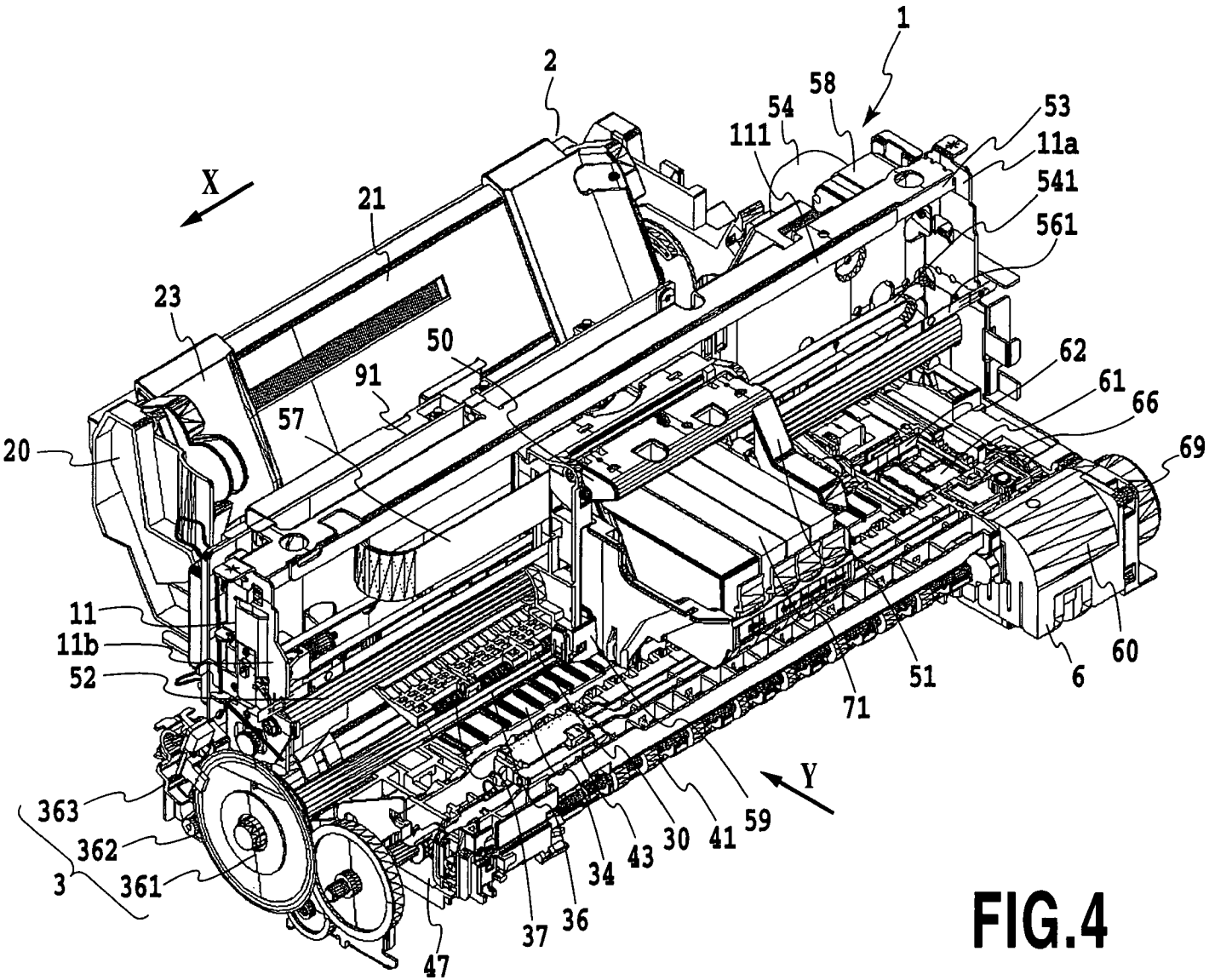
FIG. 4 is a perspective view of the first embodiment of the ink jet printing apparatus, showing the mechanical construction as seen from diagonally above on the left side.
Figure 5:
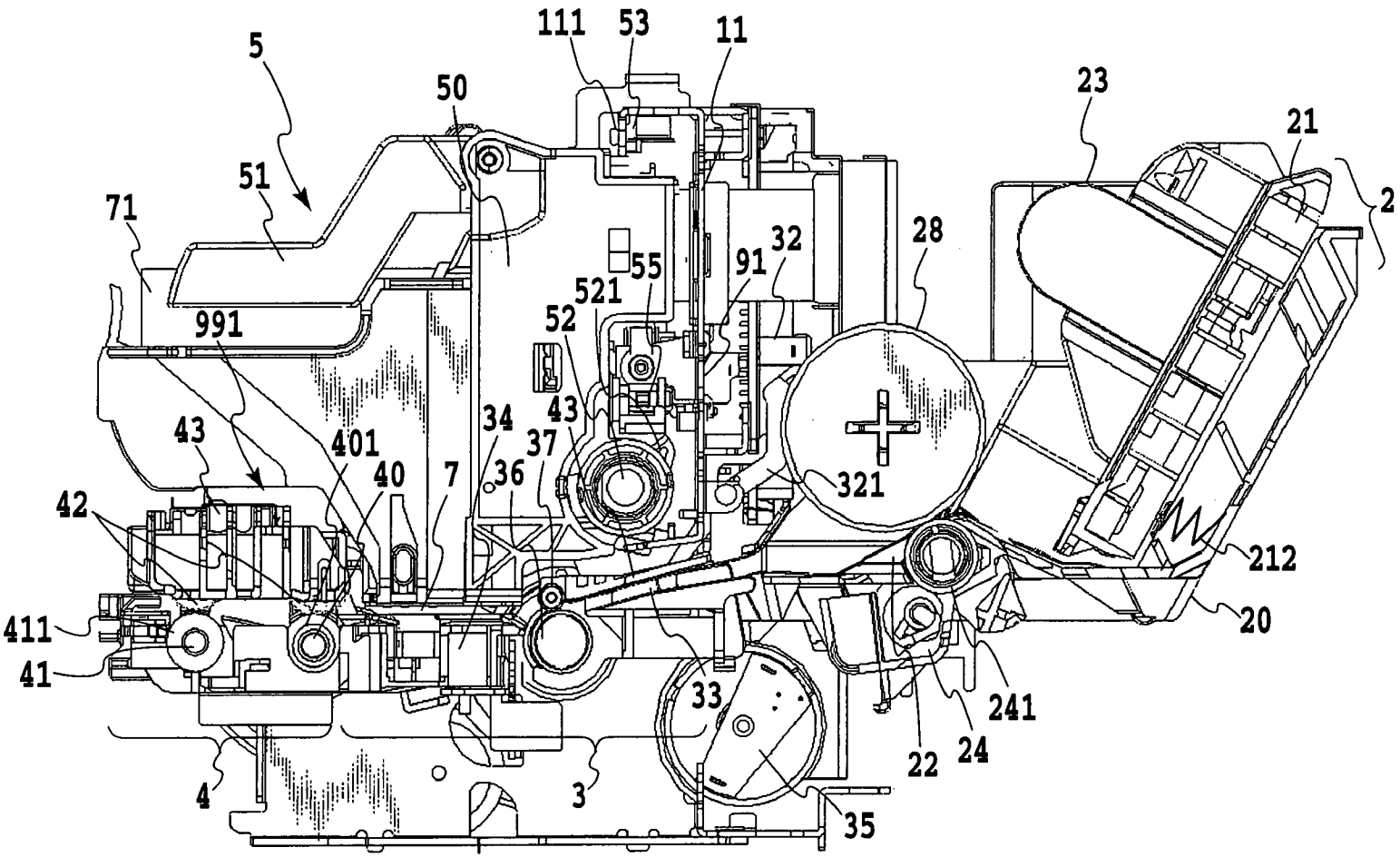
FIG. 5 is a cross-sectional view showing the mechanical construction of the first embodiment of the ink jet printing apparatus.
Figure 6:
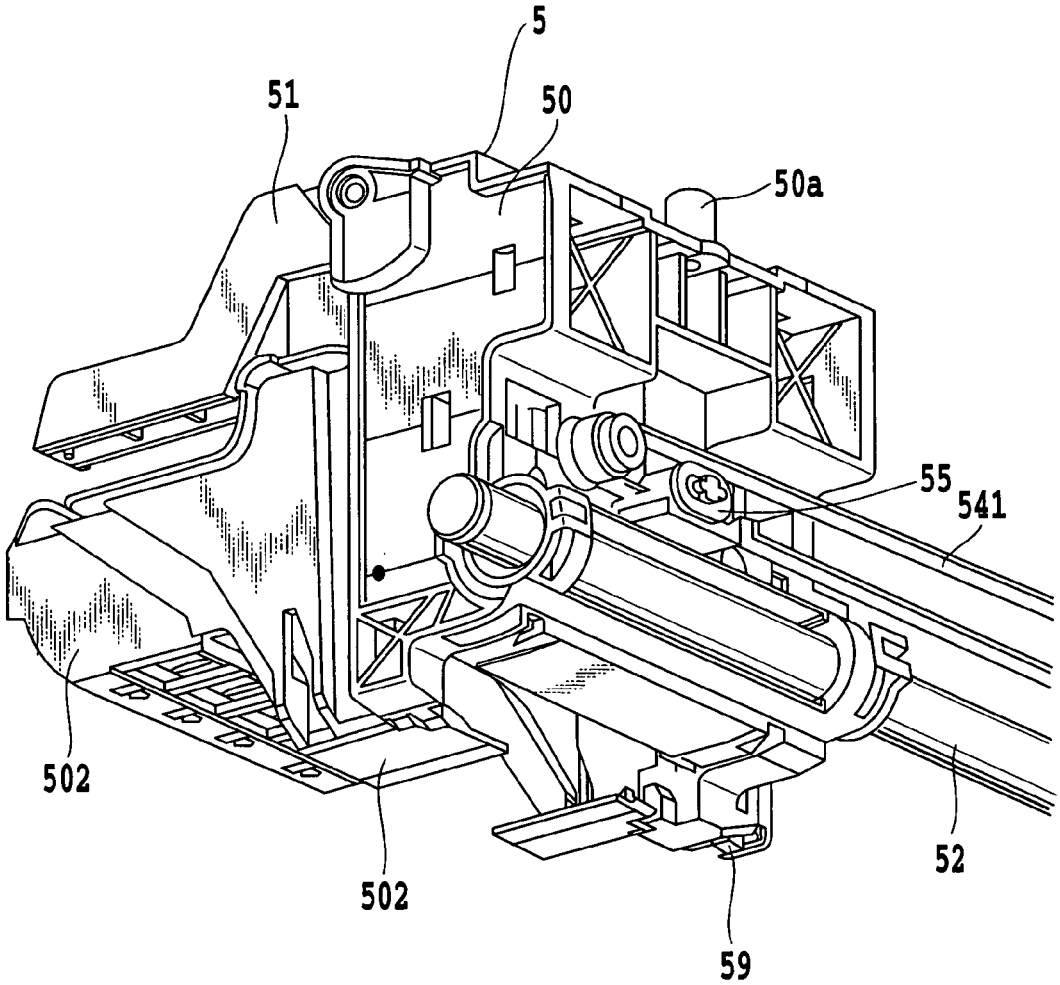
FIG. 6 is an explanatory perspective view showing a carriage, a printing unit in the first embodiment of the ink jet printing apparatus.
Figure 7:
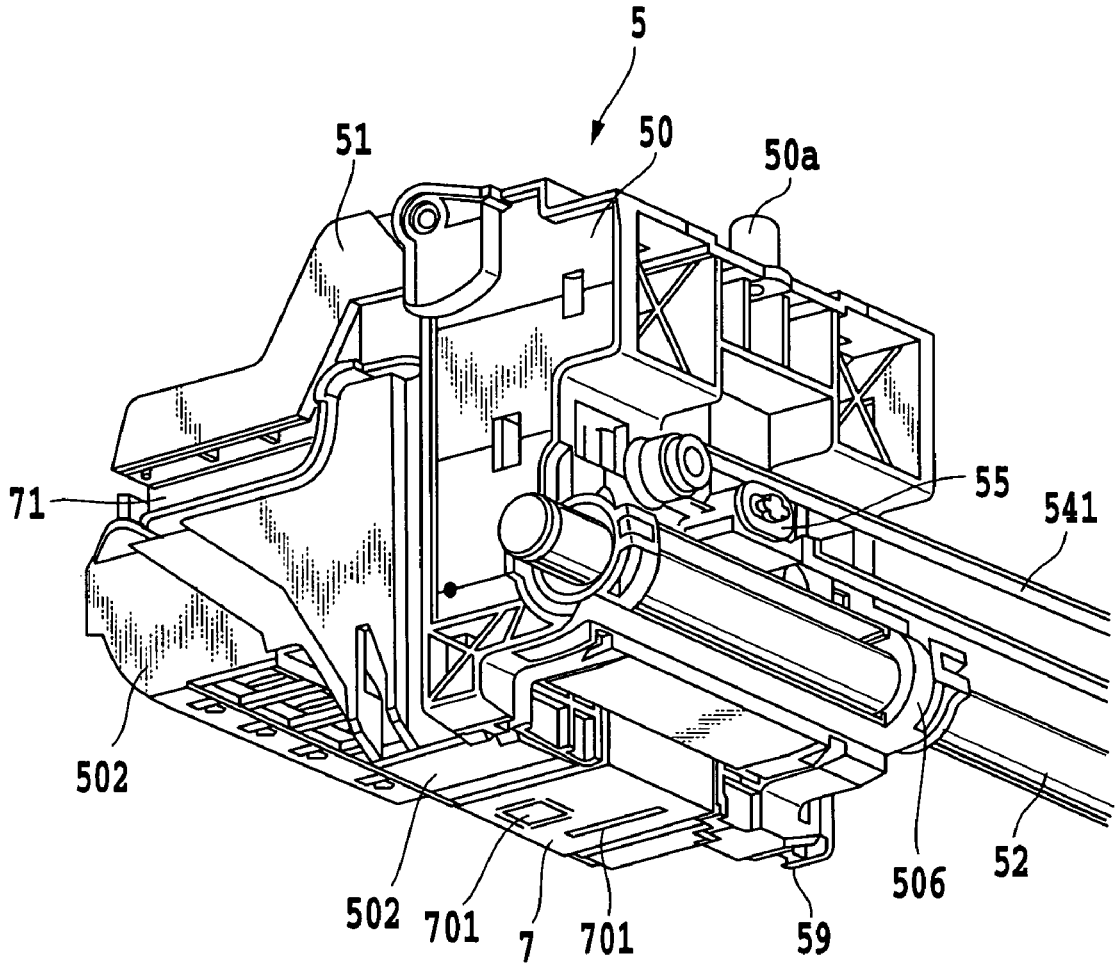
FIG. 7 is an explanatory perspective view showing the carriage, a printing unit in the first embodiment of the ink jet printing apparatus, with an ink tank mounted.

A first embodiment of the invention will be explained by referring to FIG. 1 to FIG. 21B. FIG. 1 and FIG. 2 are perspective views of an ink jet printing apparatus in the first embodiment of the invention. FIG. 3 and FIG. 4 are perspective views showing a mechanical construction of the ink jet printing apparatus in the first embodiment. FIG. 5 is a cross-sectional view showing a mechanical construction of the ink jet printing apparatus. FIG. 6 and FIG. 7 are explanatory views showing a carriage, a printing unit of the ink jet printing apparatus. FIG. 8A to FIG. 19F illustrate a CD printing.

The printing apparatus 1 of this invention comprises a paper supply unit 2, a paper transport unit 3, a paper discharge unit 4, a carriage unit 5, a cleaning unit 6, a print head 7, a CD transport unit 8, and a housing unit 9. These are briefly sequentially explained in the following.

(A) Paper Supply Unit

The paper supply unit 2, as shown in FIG. 5, has as main components a pressure plate 21 on which a large number of sheets of paper P are stacked, a feed roller 28 to feed the sheet P toward the print head, a separation roller 241 to separate the sheet P, and a return lever 22 to return the sheet to a paper stack position, all mounted on a base 20.

As shown in FIG. 2, a paper supply tray 26 for holding stacked sheets P is mounted on the base 20 or housing. The paper supply tray 26 is comprised of a plurality of plate members so that it is flexibly expandable. In use, the plate members are pulled out to increase a supported area of the sheets P.

The feed roller 28 is made of a bar-like material with a circular cross-section. This feed roller 28 has a rubber separation roller to feed a sheet of paper. The feed roller 28 is driven by a dedicated feed motor 273 (see FIG. 3) installed in the paper supply unit 2 through a drive force transmission gear and a planetary gear (not shown).

The pressure plate 21 is provided with a movable side guide 23 that can be moved to restrict a stacking position of the sheets P in a width direction (perpendicular to the feed direction). The pressure plate 21 is pivotable about a rotary shaft connected to the base 20 and is urged toward the feed roller 28 by a pressure plate spring 212. At a position on the pressure plate 21 that opposes the feed roller 28, a separation seat made of a material with a large frictional coefficient, such as an artificial leather, is provided (not shown) to prevent a double feeding of sheets P near the bottom of the sheet stack. The pressure plate 21 is brought into or out of engagement with the feed roller 28 by a pressure plate cam (not shown).

Further, mounted on the base 20 is a separation roller holder 24, which holds the separation roller 241 for separating the sheets P one by one and is supported rotatably on a rotary shaft provided on the separation base 20. The separation roller holder 24 is urged toward the feed roller 28 at all times by a separation roller spring (not shown). The separation roller 241 is fitted with a clutch spring (not shown). When the separation roller 241 is applied with more than a predetermined load in the rotating direction, a portion supporting the separation roller 241 rotates, thus protecting the separation roller 241 and associated components from being loaded excessively. The separation roller 241 can be brought into or out of engagement with the feed roller 28 by a separation roller release shaft and a control cam (both not shown). Positions of the pressure plate 21, return lever 22 and separation roller 241 are detected by ASF sensors (not shown).

The return lever 22 for returning a sheet P to the paper stack position is rotatably mounted on the base 20 and urged by a return lever spring (not shown) toward a released position. When a sheet P is to be returned, the return lever 22 is rotated against the force of the return lever spring by the control cam to return the sheet P to the paper stack position.

How a sheet of paper is supplied using the above construction will be described.

In a normal standby state, the pressure plate 21 is urged by the pressure plate cam to part from (or disengage from) the feed roller 28 so that stacked sheets of paper are out of contact with the feed roller 28. The separation roller 241 is urged by the control cam to part from (or disengage from) the feed roller 28. The return lever 22 is rotated in such a direction as to return any advancing sheets P and is moved to a position such that it closes an opening to the stacked sheets to prevent the stacked sheets when loaded from moving forward into the transport path.

When in this standby state a paper feed is demanded, the motor is driven to cause the separation roller 241 to engage the feed roller 28. Then, the return lever 22 is released and the pressure plate 21 is moved toward the feed roller 28 until the sheets P stacked on the pressure plate 21 come into contact with the feed roller 28. In this state, the sheets P begin to be supplied. At this time, there is a possibility of two or more sheets P being fed simultaneously. These sheets P are restricted by a front stage separation unit (not shown) provided on the base 20 so that only a predetermined number of sheets are fed to a nip portion between the feed roller 28 and the separation roller 241. The sheets P thus supplied are separated by the nip portion and only the top sheet is further fed.

When the sheet P reaches a transport roller 36 and a pinch roller 37 (described later), the pressure plate 21 and the feed roller 28 are returned to their release positions by the pressure plate cam 214 and the control cam, respectively. The return lever 22 is returned to the paper stack position by the control cam. At this time, the sheets P that were supplied to the nip portion formed by the feed roller 28 and the separation roller 241 are returned to the paper stack position.

(B) Paper Transport Unit

The sheet P, such as print paper, supplied from the paper supply unit is transported by the paper transport unit 3 shown in FIG. 3 and FIG. 4 along a transport path to the print head. The paper transport unit 3 is mounted to a chassis 11 formed of a metal sheet and has a transport roller 36 for feeding the sheet P. The transport roller 36 is constructed of a metal shaft with its surface coated with fine ceramic particles to provide a high friction. The transport roller 36 is supported at its both ends on bearings fixed in the chassis 11. Between the transport roller 36 and the bearings is provided a transport roller tension spring that gives a predetermined load to the transport roller during rotation to ensure a stable transport of paper.

Engaged with a circumferential surface of the transport roller 36 are a plurality of pinch rollers 37 that follow the rotation of the transport roller. The pinch rollers 37 are rotatably mounted on a pinch roller holder 30 that is pivotally supported by a rotating shaft on the chassis 11. The pinch roller holder 30 is urged by a pinch roller spring (not shown) so that the pinch rollers 37 are pressed against the circumferential surface of the transport roller 36. In this construction, the sheet P that was supplied from the paper supply unit 2 is held between the transport roller 36 and the pinch rollers 37 and transported by the rotating force of the transport roller 36. The pinch roller holder 30 is pivotally supported by the rotating shaft on bearings mounted in the chassis 11. At an inlet of the paper transport unit 3 to which the sheet P is supplied, a paper guide flapper 33 (see FIG. 5) for guiding the sheet P and a platen 34 are provided.

The pinch roller holder 30 is provided with a movable PE sensor lever 321 that is moved depending on the presence or absence of the sheet P. A position of the moved PE sensor lever 321 (see FIG. 5) is detected by a PE sensor to determine positions of front and rear ends of the print paper. The platen 34 is mounted to the chassis 11 and the paper guide flapper 33 has one of its ends rotatably supported and fitted in the transport roller 36 and is positioned by engaging the chassis 11. Downstream of the transport roller 36 in the sheet transport direction (Y direction) is provided a print head 7 that forms an image according to image information.

In the above construction, as shown in FIG. 5, the sheet P that was fed from the paper supply unit 2 to the paper transport unit 3 is guided by the pinch roller holder 30 and the paper guide flapper 33 and forwarded to a roller pair of the transport roller 36 and the pinch roller 37. At this time, the PE sensor 32 detects a front end of the sheet P that was transported to the PE sensor lever 321, thus locating a print position of the sheet P. The sheet P is further fed over the platen 34 as the paired rollers 36, 37 are rotated by a transport motor 35. The platen 34 is formed with ribs that constitute a transport reference surface as shown in FIG. 3 and FIG. 4. A gap between the ribs and the print head 7 is controlled and a sheet waving phenomenon in which a sheet applied with ink easily elongates and waves is also controlled to prevent the sheet from waving excessively.

The transport roller 36 is driven by a rotating force of the transport motor 35 constructed of a DC motor which is transmitted through a timing belt 561 to a pulley 542 provided on the shaft of the transport roller 36. The shaft of the transport roller 36 is fitted with a code wheel 361 that is formed with markings at a predetermined pitch of 150–300 lpi. An encoder sensor 363 for reading the markings is mounted on the chassis 11 at a position adjacent the code wheel 361.

An ink tank 71 connected to the print head has a plurality of ink tanks of different ink colors that can be replaced individually. The print head 7 has electrothermal transducers (heaters) as ink ejection drive elements installed one in each nozzle. These electrothermal transducers are turned on or off to apply heat to ink in each nozzle to cause a film boiling in ink which in turn causes a bubble to grow or collapse, producing a pressure change and thereby ejecting an ink droplet from the nozzle.

(C) Carriage Unit

The carriage unit 5 has a carriage 50 mounting the print head 7. The carriage 50 has a slide portion 50*b* for a guide shaft 52 and, at the upper end portion thereof, a slide portion 50*a* for a guide rail 111 (see FIG. 6 and FIG. 7). The guide shaft 52 extends in a direction perpendicular to the transport direction of the sheet P (in a Y direction of FIG. 3 and FIG. 4). Along this guide shaft 52 the carriage 50 can be reciprocally moved for scan. The guide rail 111 and the guide shaft 52 determine a gap between the print head 7 mounted on the carriage 50 and the sheet P. The guide shaft 52 and the guide rail 111 are secured to the chassis 11. A sliding portion of the guide rail 111 with the carriage 50 is lined with a thin sliding sheet 53 of stainless steel, for example, to reduce sliding noise.

The carriage 50 is driven by a carriage motor 54 mounted on the chassis 11 through a timing belt 541. The timing belt 541 is wound around and tensed by an idle pulley 542. The timing belt 541 is connected to the carriage 50 through a damper 55 made of rubber or the like which attenuates vibrations caused by the rotation of the carriage motor 54 to achieve a stable travel performance of the carriage 50.

A code strip 561 formed with markings at a predetermined pitch of 150–300 lpi to detect a position of the carriage 50 is provided parallel to the timing belt 541. Further, an encoder sensor (not shown) to read the code strip 561 is provided on a carriage base plate on which the carriage 50 is mounted. The carriage base plate (not shown) is also provided with contacts for electrical connection with the print head 7. The carriage 50 also has a flexible cable 57 through which to transmit a head signal from an electric board (here a main printed circuit board) 91 to the print head 7. With a carriage position where the carriage 50 contacts the chassis 11 taken as a reference position, the encoder sensor that reads the code strip 561 outputs a position signal whenever necessary for the detection of the position of the carriage 50 as shown in FIGS. 3 and 4.

The print head 7 is removably mounted on the carriage 50. That is, the carriage 50 has a tank cover 502 to securely hold the print head 7. The print head 7 is removably mounted in a space formed by the carriage 50 and the tank cover 502. The carriage 50 also has an abutment portion against which the print head 7 is pushed to position it at a predetermined portion of the carriage 50, and a pressing means (not shown) to press and fixedly hold the print head 7. The pressing means is mounted to a head set lever 51. With the head set lever 51 pivoted about a fulcrum and set, the pressing means acts to fix the print head 7 in the carriage 50.

A state of the print head 7 mounted on the carriage 50 as described above is shown in FIG. 7. The print head 7, when mounted on the carriage 50, has an ink ejection portion 701 opposed to the transport unit and spaces near the ink ejection portion 701 are enclosed by the tank cover 502 so that in the event a print medium such as sheet curls, the print medium can be prevented from being caught by the carriage 50.

Figure 8A:
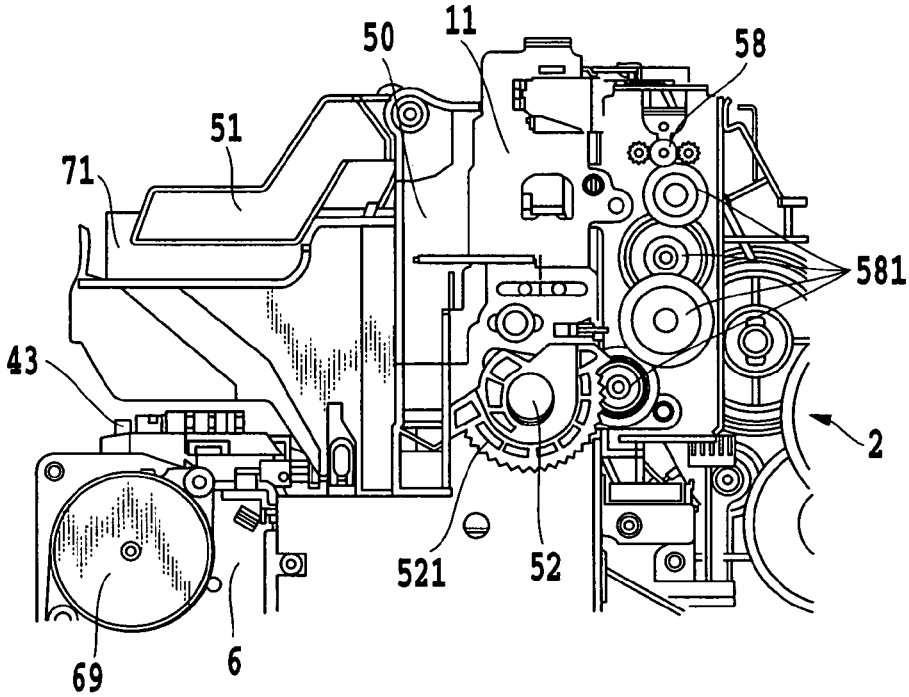
FIGS. 8A and 8B are side views of the apparatus of FIG. 7.
Figure 8B:
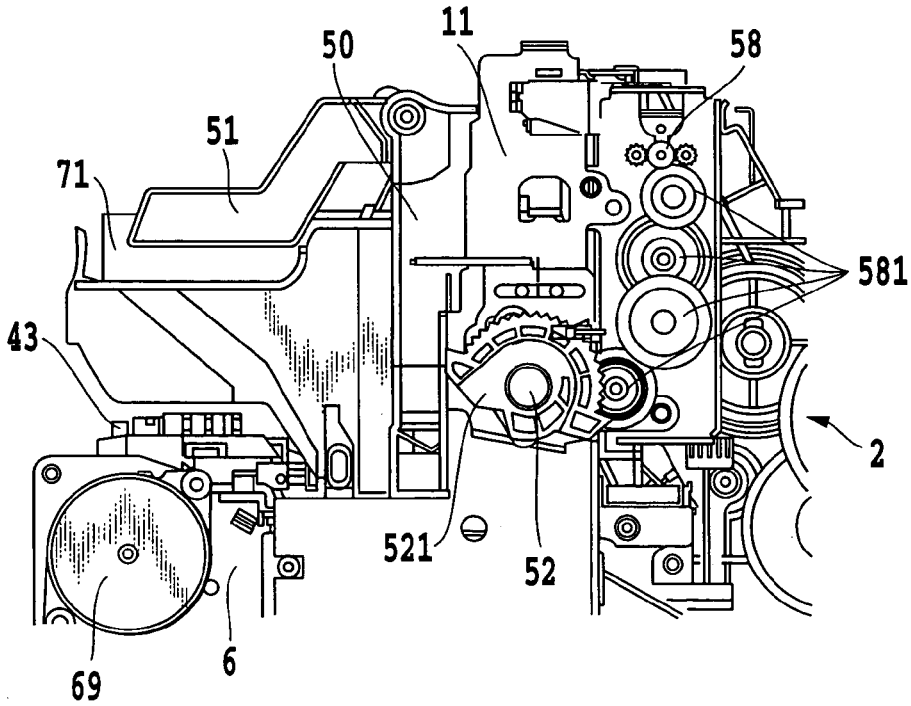

Further, the guide shaft 52 (described later) in more detail is fitted at its ends with a left-side eccentric cam 521 and a right-side eccentric cam (not shown), as shown in FIGS. 3, 8A and 8B. A drive force of a carriage lift motor 58 is transmitted to the left-side eccentric cam 521 through a gear train 581 to raise or lower the guide shaft 52. The vertical movement of the guide shaft 52 causes the carriage 50 to be lifted or lowered to keep an optimum gap for different thicknesses of sheets P.

The carriage 50 is also provided with a tray position detection sensor 59 which is constructed of a reflection type optical sensor to read a mark 82 for determining a position of a CD tray 83 (described later). This sensor 59 can detect the position of the tray 83 by emitting a light from a light emitting element and receiving a reflected light.

In the above construction, when an image is to be formed on a sheet P, the paired rollers 36, 37 intermittently feed the sheet P in the transport direction Y and at the same time the carriage 50 is moved by the carriage motor 54 in a direction X perpendicular to the sheet transport direction. During this process, the print head 7 receives a print signal from the main printed circuit board 91 and, according to the print signal, ejects ink droplets onto the sheet P to form an image.

(D) Paper Discharge Unit

The paper discharge unit 4 includes, as shown in FIG. 3 and FIG. 4, two discharge rollers 40, 41, spurs 42 kept in engagement with the discharge rollers 40, 41 under a predetermined pressure and idly rotated by them, and a gear train (not shown) to transmit a driving force of the transport roller to the discharge rollers 40, 41.

The discharge rollers 40, 41 are mounted to the platen 34. The discharge roller 40 located upstream of the sheet P in the transport direction (hereinafter simply described as "upstream") is constructed of a metal shaft with a plurality of rubber portions. The driving force of the transport roller 36 is conveyed through an idler gear to the discharge roller 40 which is then rotated. The discharge roller 41 is constructed of a resin shaft with a plurality of elastic portions formed of, for instance, an elastomer. A driving force to the discharge roller 41 is transmitted from the discharge roller 40 through an idler gear.

The spurs 42 have a plurality of pointed portions along a circumference of a thin stainless steel plate of almost circular shape with a resin portion integrally secured to the circumferential surface of the stainless steel disc. The spurs 42 are pivotally mounted to a spur holder 43. The spurs 42 are held to the spur holder 43 by spur springs 44, each formed of a bar-like coil spring, which also press the spurs 42 against the discharge rollers 40, 41. The spurs 42 are provided at positions corresponding to the rubber portions and elastic portions of the discharge rollers 40, 41. The spurs 42 have two functions, one for generating a force for transporting the sheet P and one for keeping the sheet P from floating while being printed. Spurs 42 for the latter function are provided between portions where a sheet transport force is generated, i.e., at positions where there are no rubber portions 401 or elastic portions 411.

In front of the discharge rollers 40, 41 is provided a paper end support (not shown) which protects an image formed on an already discharged sheet P from being damaged by a newly discharged sheet P sliding on the printed surface of the already discharged sheet P. The paper end support is constructed of a resin member with rolls attached at its front end. The resin member is urged by a paper support spring to press the rolls under a predetermined pressure against an unprinted surface of the sheet P being discharged. This causes the sheet P to be lifted at its lateral side portions so that it is stiffened and can be held above the already discharged sheet P.

With the above construction, the sheet P that was printed by the carriage unit 5 is held in a nip between the discharge rollers 40, 41 and the spurs 42 and discharged onto a discharge tray 46. The discharge tray 46 is constructed of a plurality (in this case, three) of divided plates and can be accommodated in a lower portion of a lower case 99 (described later). In use, the divided plates are drawn out. The discharge tray 46 rises in height toward its front end with its lateral end portions set higher than other portions to improve a discharged sheet stacking performance and prevent image degradations due to rubbing of the printed surface.

(E) Cleaning Unit

The cleaning unit 6, as shown in FIG. 3 and FIG. 4, includes a pump 60 for cleaning the print head 7, a cap 61 for preventing the drying of the print head 7, a blade unit 62 for cleaning a nozzle face of the print head 7, and a dedicated motor (cleaning motor; see FIG. 7) for driving the pump 60.

This dedicated cleaning motor 69 (see FIGS. 8A and 8B) has a one-way clutch (not shown) so that a motor rotation in one direction activates the pump and in the opposite direction activates the blade unit 62 and the vertical movement of the cap 61.

The pump 60 produces a negative pressure by squeezing two tubes made of a flexible member (not shown) with a pump roller. The pump 60 is connected to the cap 61 through a valve. The cap 61 can be moved up or down to hermetically enclose the nozzle face of the print head 7 or release it. With the cap 61 in hermetic contact with the print head, the pump 60 is activated to suck out ink not suited for printing from the print head 7. In the cap 61 is provided a cap absorbent 711 to reduce the amount of ink remaining on the face of the print head 7. In this embodiment, to prevent the residual ink in the cap absorbent 711 from becoming sticky and solid, the pump 60 is operated with the cap 61 open to draw out the ink remaining in the cap 61. The waste ink sucked out by the pump 60 is absorbed by and retained in a waste ink absorbent (not shown) provided in the lower case 99 (described later).

The above sequence of operations, including the vertical movement of the cap 61 and the operation of the blade unit 62, is controlled by a main cam (not shown) that has a plurality of cams on a shaft. This control action is accomplished by an interaction between the cams of the main cam and corresponding arms (not shown) in contact with these cams. The position of the main cam can be detected by a position detection sensor such as a photo interrupter. When the cap 61 is lowered (open), the blade unit 62 is moved perpendicularly to the scan direction of the carriage unit 5 to clean the face of the print head 7. The blade unit 62 has two types of blades, one for cleaning an area on the print head 7 on and around nozzles and one for cleaning the entire face. When the blade unit 62 moves back to a retracted position, it engages a blade cleaner 66 to remove ink from the blade unit 62 itself.

(F) Housing Unit

Figure 9:
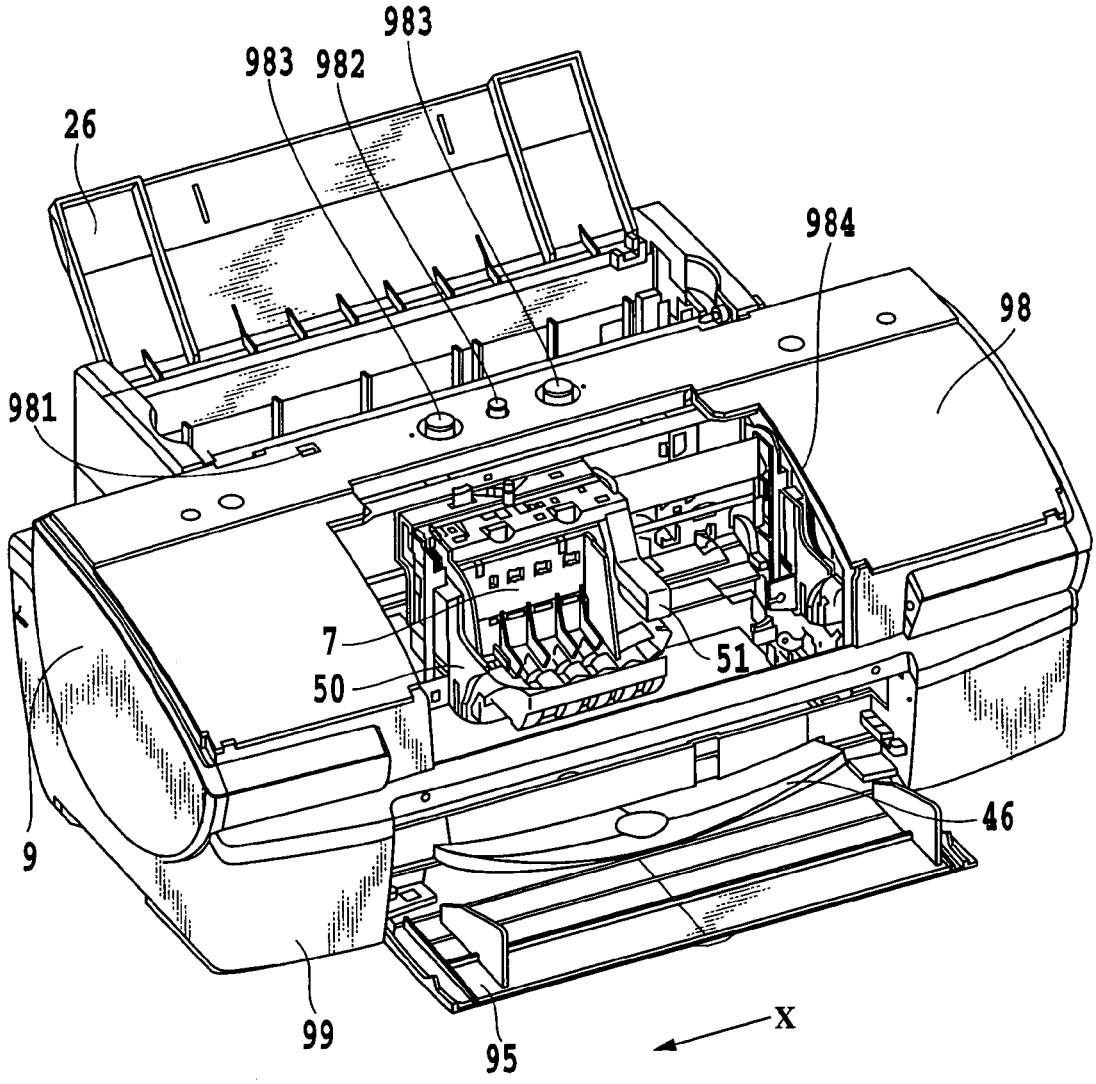
FIG. 9 is a perspective view showing a replacement position for a print head and an ink tank in the first embodiment of the ink jet printing apparatus.

The units described above are assembled into the chassis 11 to form a mechanical construction of the ink jet printing apparatus. Enclosing the mechanical construction is a housing unit 9, as shown in FIGS. 1, 2 and 9. The housing unit includes mainly a lower case 99, an upper case 98, an access cover 97, a connector cover (not shown), and a front cover 95.

In the lower part of the lower case 99 is accommodated, along with a discharge tray rail, the discharge tray 46 made up of a plurality of plate members formed collapsible in two or more tiers. The front cover 95 can close a paper discharge opening when the apparatus is not in use.

The upper case 98 is provided with an access cover 97 which is pivoted to be opened. As shown in FIG. 9, the upper case 98 has an opening in a part of a top surface thereof. By moving the carriage 50 to a position corresponding to this opening, the ink tank 71 and the print head 7 can be removed from or mounted to the carriage 50. The upper case 98 is also provided with a door switch lever for detecting the opening or closing of the access cover, an LED guide 982 for transmitting LED light for indication, and key switches 983*a*, 983*b* connected to switches on a printed circuit board. When the access cover 97 is pivoted, the door switch lever is operated to detect that the access cover 97 is open. Further, the upper case 98 is also fitted with the pivotable multistage paper supply tray 26. When the paper supply unit 2 is not in use, the paper supply tray 26 can be folded inwardly to function as a cover on the paper supply unit 2. FIG. 9. omits the access cover.

The upper case 98 and the lower case 99 are held together by elastic engagement claws. A connector (not shown) for making electrical connections with a personal computer is enclosed by a connector cover (not shown).

(G) CD Transport Unit

Figure 10A:
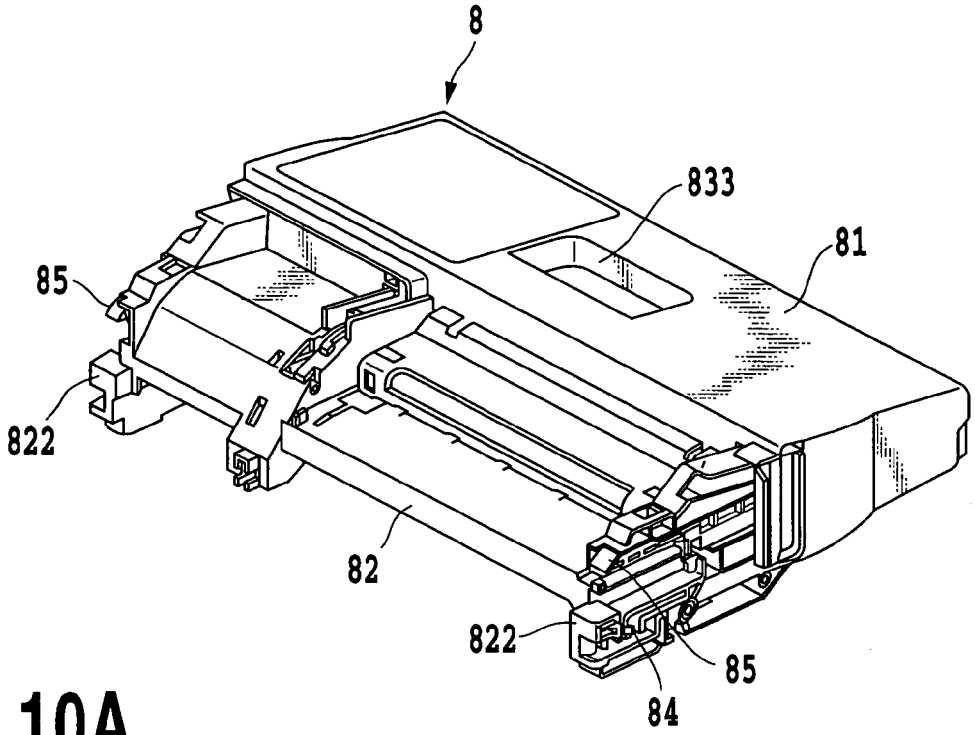
FIGS. 10A and 10B are perspective views showing a CD transport unit in the first embodiment of the invention.
Figure 10B:
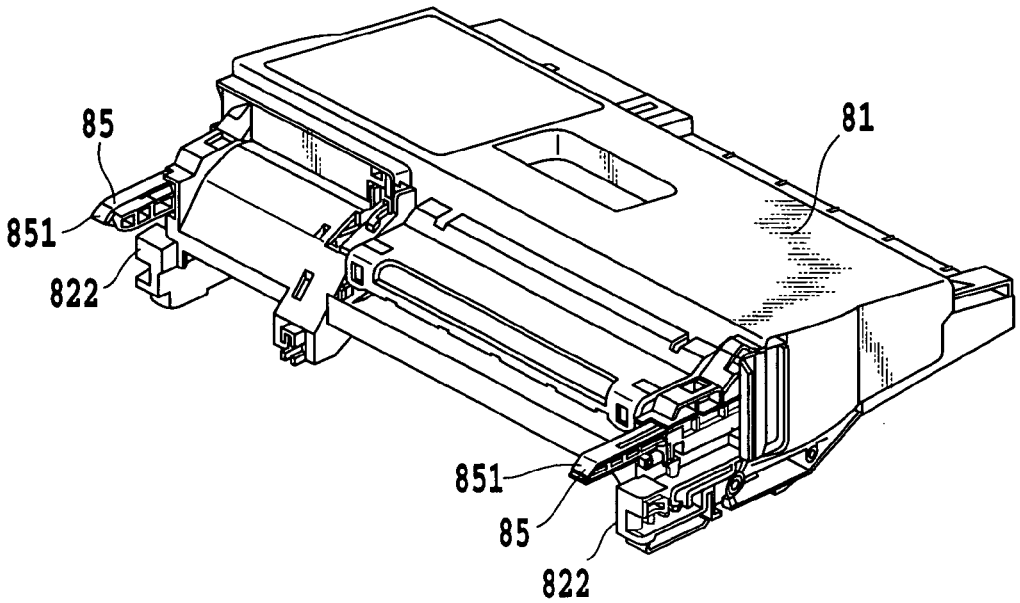
Figure 11:
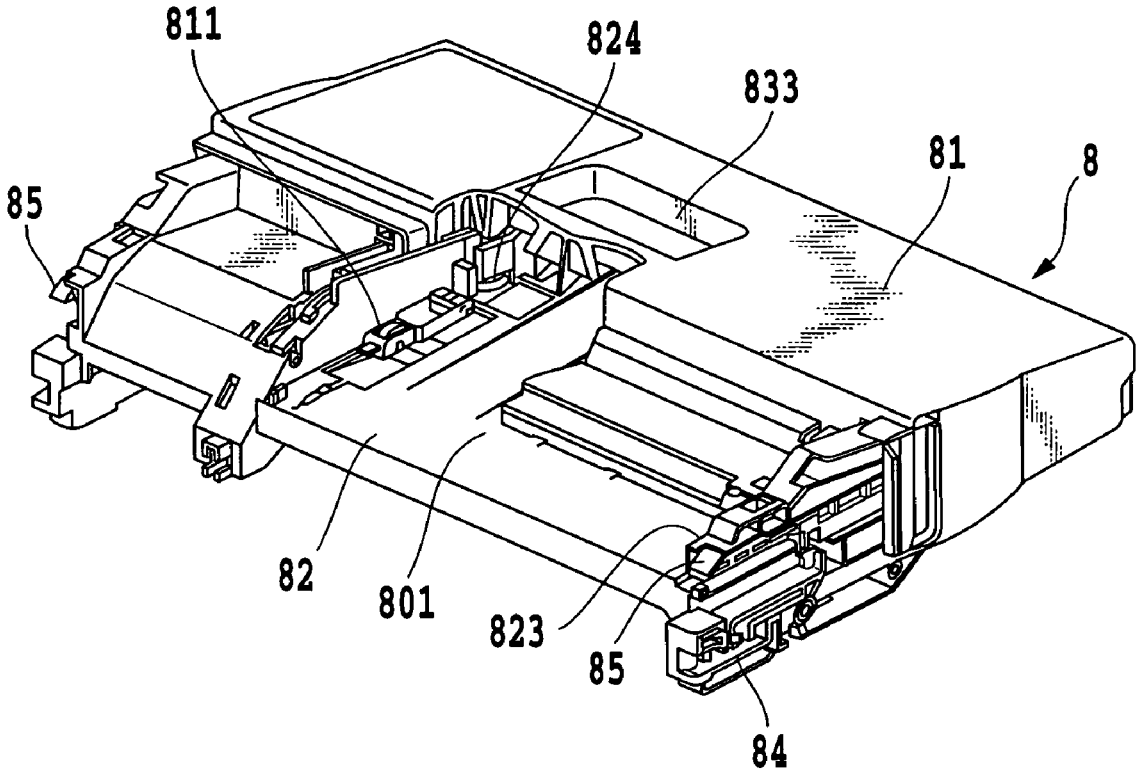
FIG. 11 is an explanatory view showing an inner construction of the CD transport unit in the first embodiment of the invention.
Figure 14A:
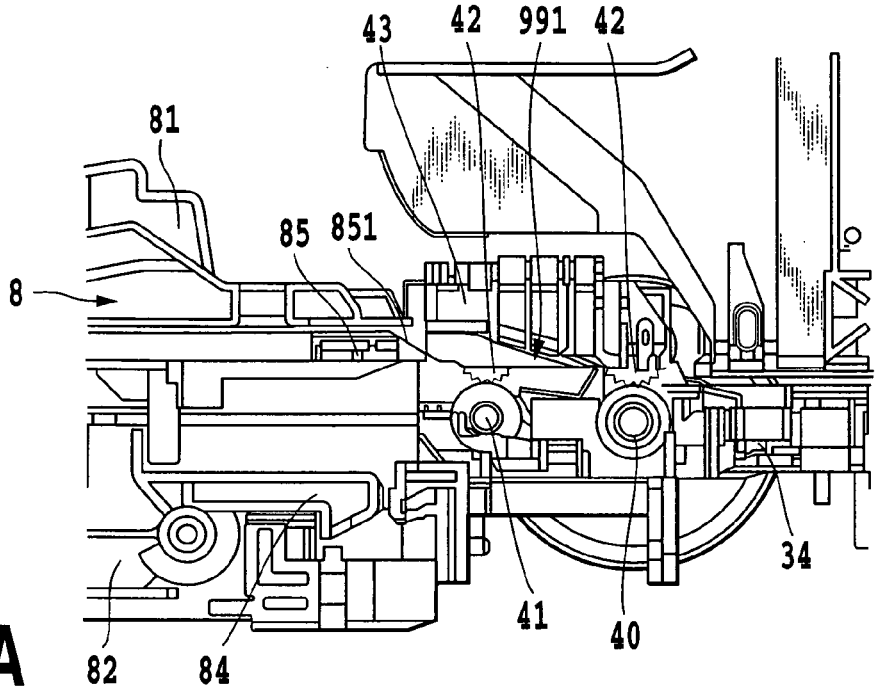
FIGS. 14A and 14B are explanatory side views showing the lower case and the CD transport unit in a printing apparatus-mounted state in the first embodiment of the invention.
Figure 14B:
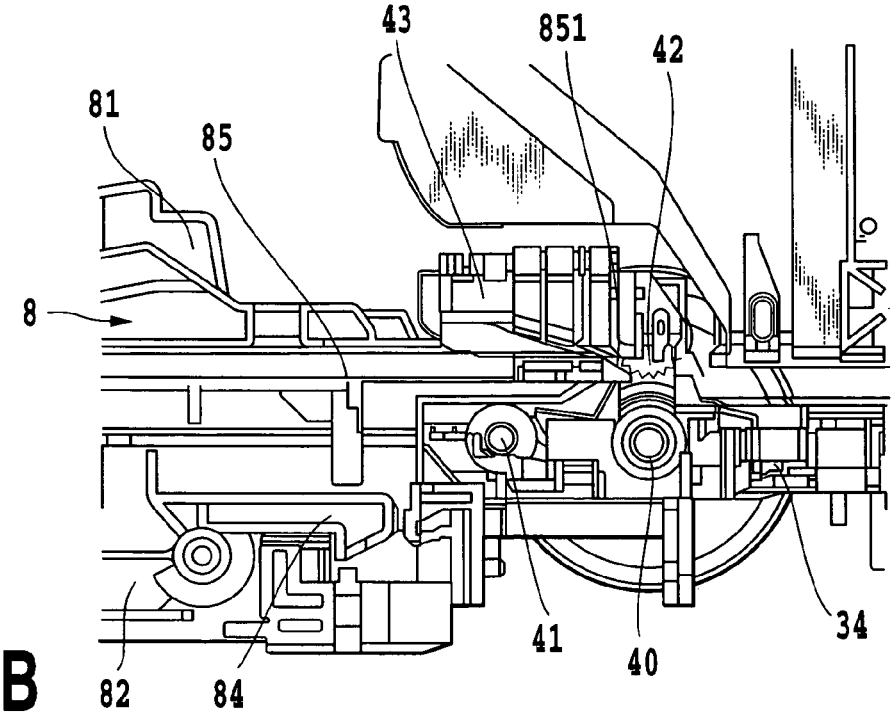
Figure 15:
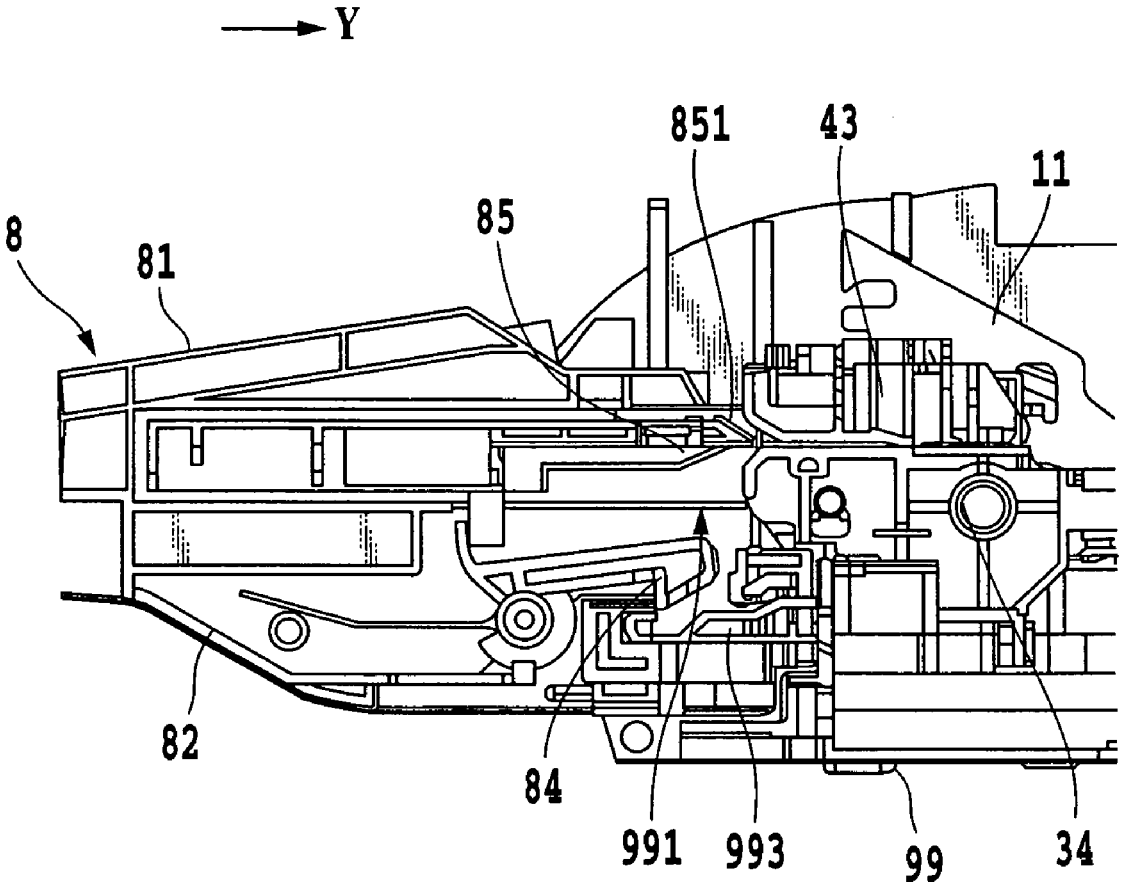
FIG. 15 is an explanatory side view showing the lower case and the CD transport unit in a hook-disengaged state in the first embodiment of the invention.
Figure 16:
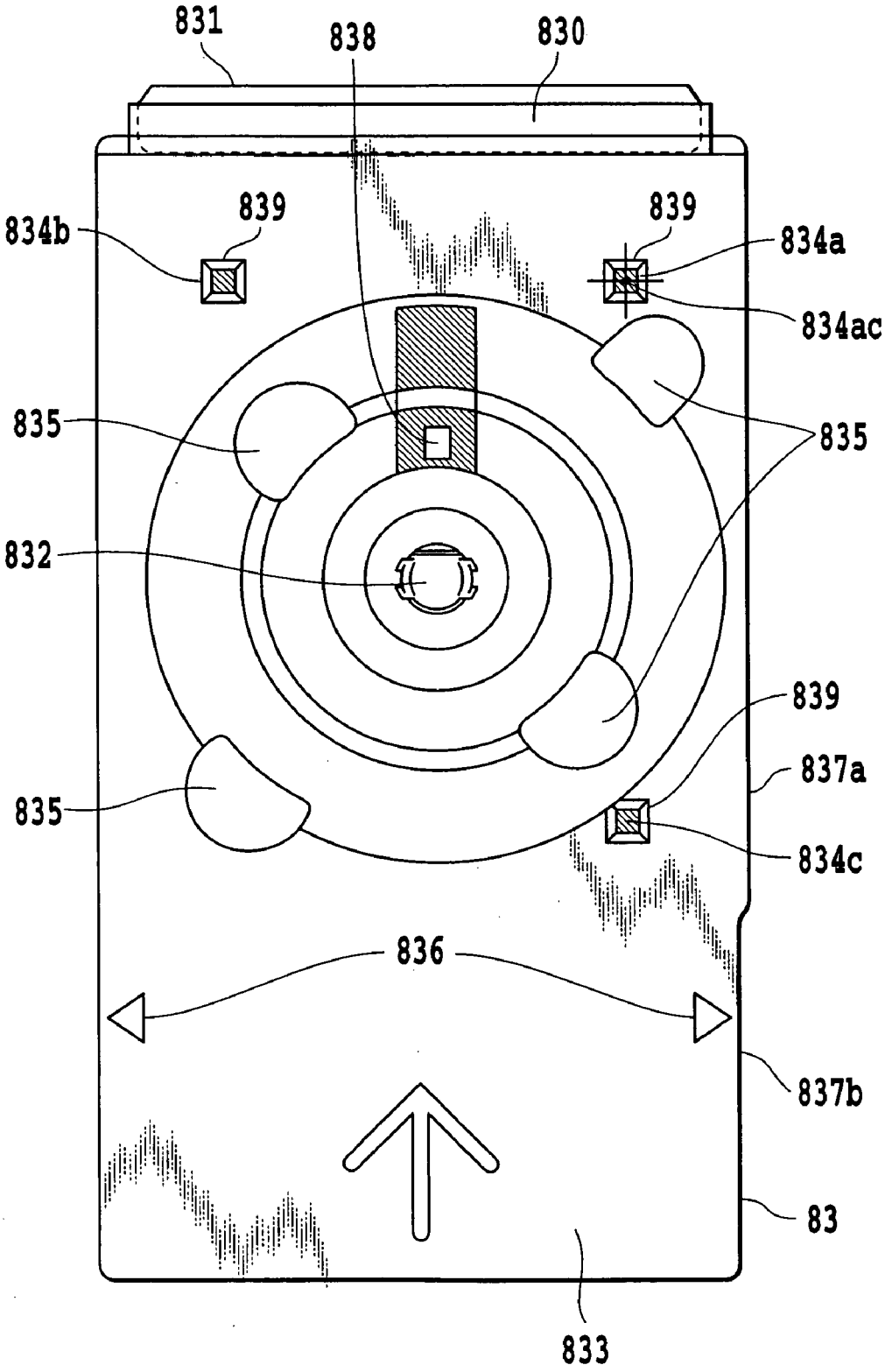
FIG. 16 is a plan view of a tray in the first embodiment of the invention.
Figure 17:
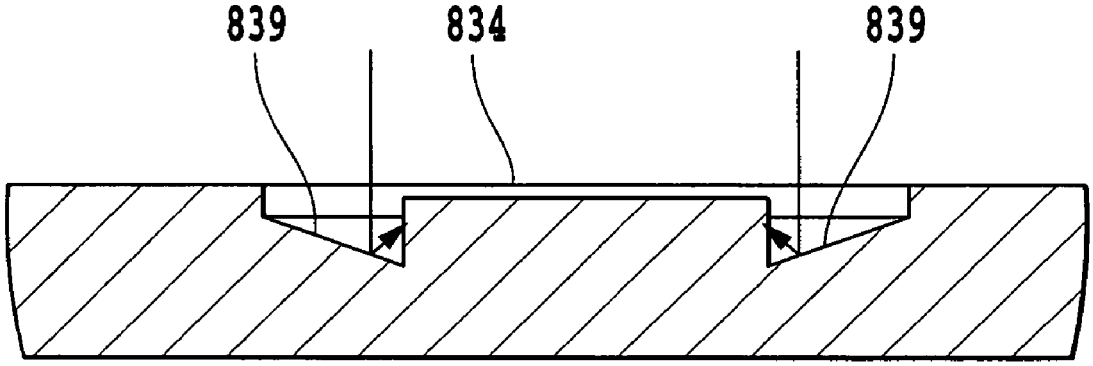
FIG. 17 is an explanatory cross-sectional view showing recesses formed in a periphery of a tray position detector in the first embodiment of the invention.
Figure 18:
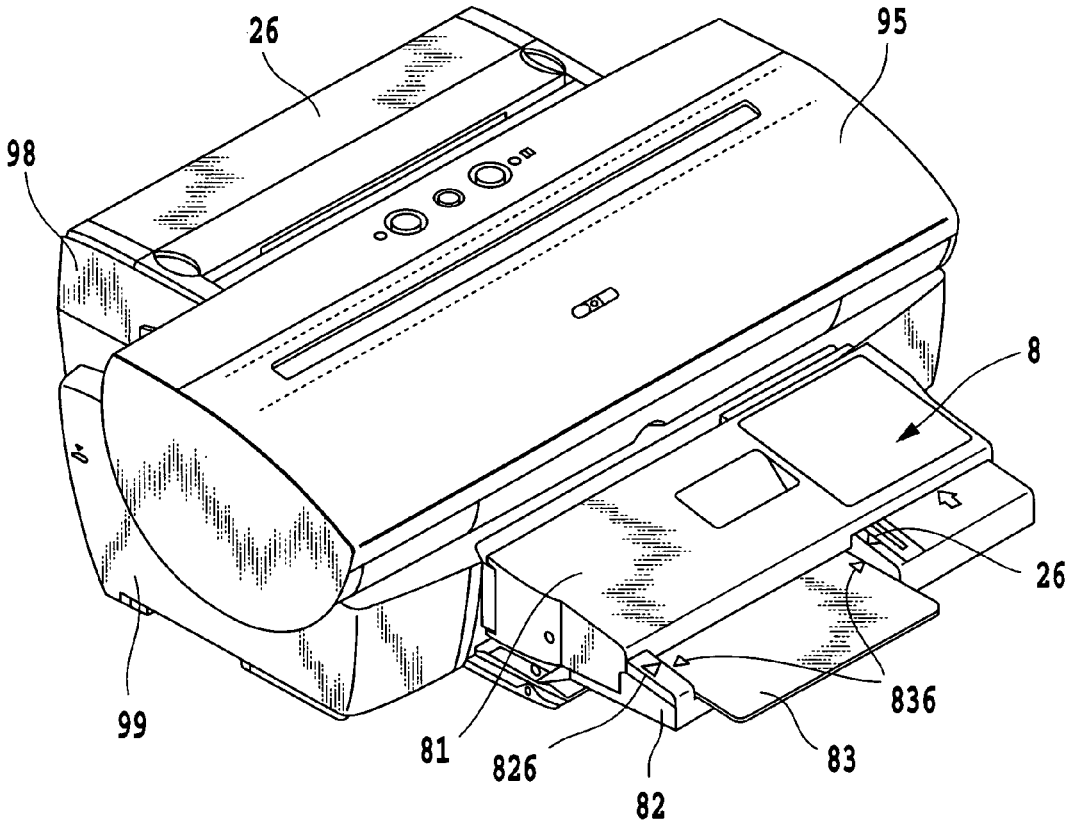
FIG. 18 is a perspective view showing the CD transport unit mounted on the printing apparatus and the tray loaded in the CD transport unit in the first embodiment of the invention.

A construction of the CD transport unit 8 and an operation of printing on a CD by using the CD transport unit will be explained by referring to FIGS. 1 to 19F. FIGS. 10A and 10B are perspective views of the CD transport unit 8, FIG. 11 an explanatory perspective view showing an interior of the CD transport unit 8, FIGS. 12A and 12B explanatory perspective views showing how the CD transport unit 8 is mounted to the printing apparatus 1, and FIG. 13 a perspective view showing a construction of a mounting portion 991 provided in the lower case 99 and of a mounting detection portion. FIGS. 14A and 14B are explanatory side views of the CD transport unit 8 and the mounting portion 991 as the CD transport unit 8 is mounted to the printing apparatus 1, with FIG. 14A showing a state before an arm provided in the CD transport unit 8 is advanced and with FIG. 14B showing a state after the arm is advanced. FIG. 15 is an explanatory view showing a hook 84 of the CD transport unit 8 engaged with the lower case 99. FIG. 16 is a plan view of the tray 83 for mounting a print medium such as CD for transport. FIG. 17 is an explanatory cross-sectional view showing recessed portions of a tray position detector of FIG. 16. FIG. 18 is a perspective view showing a state of the printing apparatus 1 in which the CD transport unit 8 is mounted to the apparatus with a slide cover 81 slid back and the tray 83 set. FIGS. 19A to 19F are explanatory plan views showing a positional relation between the tray position detection sensor 59 provided on the carriage 50 and the tray 83.

In these figures, the CD mounting tray 83 (see FIG. 16) is supported in the CD transport unit 8. As shown in FIGS. 14A, 14B and FIG. 15, the CD transport unit 8 includes a tray guide (tray support means) 82, a slide cover 81 that forms an opening for inserting the tray 83 into the tray guide 82, a hook 84 provided in the lower case 99 to hold the CD transport unit 8 to the lower case 99, and a pair of left and right arms 85 which, when the CD transport unit 8 is mounted to the printing apparatus 1, causes the spur holder 43 (described later) to slide upward in the apparatus.

A tray insertion portion 801 (see FIG. 11) in the CD transport unit 8 is formed with a reference wall 823 as a reference for the insertion position of the tray 83. On a wall surface opposing the reference wall 823 is provided a side pressure roller 824 that is urged by a roll spring (not shown) to protrude from the wall surface. The side pressure roller 824 presses the tray 83 loaded into the tray insertion portion 801 against the reference wall 823 to position it in the lateral, horizontal direction (perpendicular to the tray insertion direction). The side pressure roller 824 presses against an external side surface 837*a* (see FIG. 16) of the tray 83 until the tray 83 is inserted to a predetermined set position. When the tray 83 is inserted to a position where it can be transported by the transport roller 36 and the pinch rollers 37 (see FIG. 3 to FIG. 5) installed in the printing apparatus 1, an escape portion 837*b* (see FIG. 16) that is recessed inwardly from the external side surface 837*a* faces the side pressure roller 824. As a result, the side pressure roller 824 no longer presses against the tray 83, releasing the sideward pressing force. Thus, during the tray transport operation, the side pressure roller 824 does not apply an unwanted back tension to the tray 83, preventing a possible degradation of tray transport accuracy.

In a tray insertion portion 801 of the slide cover 81 in the CD transport unit 8 a pair of left and right press rollers 811 are rotatably supported so that they are vertically movable. The press rollers 811 are urged upward by roll springs (not shown). The tray 83 inserted into the tray insertion portion 801 is supported elastically by the force of the roll springs. When the CD transport unit 8 is mounted to the mounting portion 991 in the printing apparatus 1, the tray 83 supported in the CD transport unit 8 is pressed against the discharge rollers 40, 41 in the printing apparatus 1 and receives a transport force from the discharge rollers 40, 41. This transport force causes the tray 83 to be transported from the set position to a nip portion between the transport roller 36 and the pinch rollers 37. Then, the tray 83 transported to the rollers 36, 37 is intermittently fed according to the movement of the carriage unit 5 in the main scan direction, thus forming an image on a CD held on the tray 83.

Figure 12A:
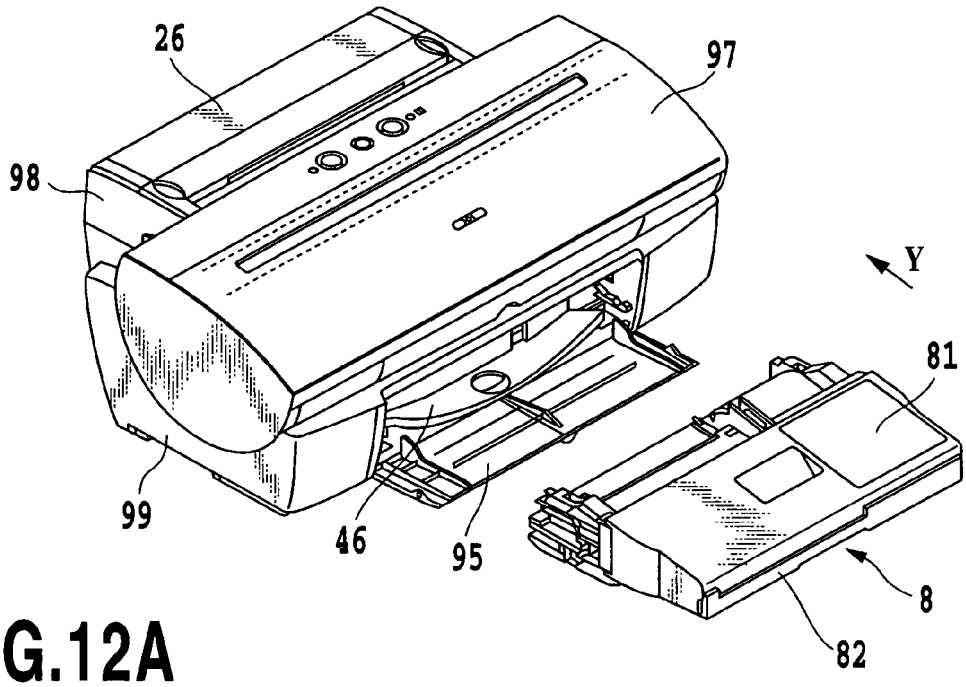
FIGS. 12A and 12B are perspective views showing how the CD transport unit is mounted to the printing apparatus in the first embodiment of the invention.
Figure 12B:
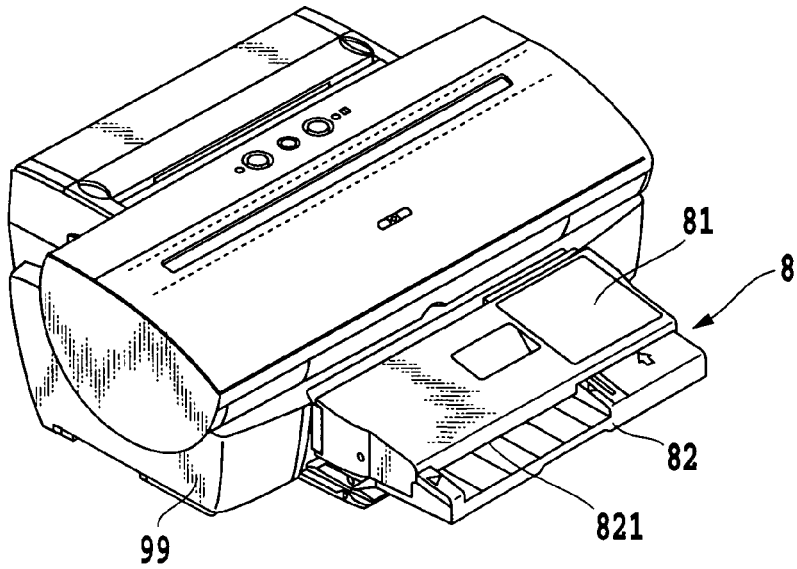
Figure 13:
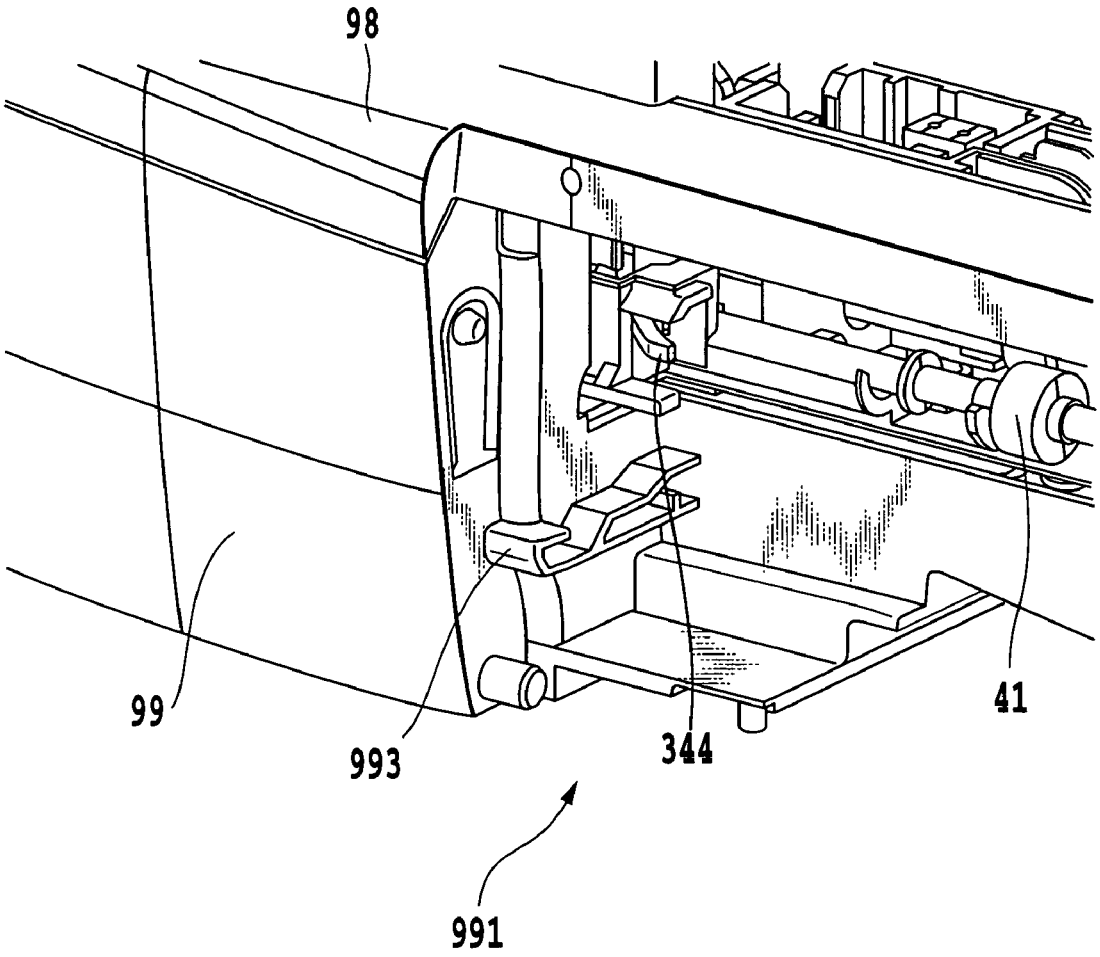
FIG. 13 is a perspective view showing a construction of a CD transport unit mounting portion and a mounting portion detector, both provided in a lower case in the first embodiment of the invention.

FIGS. 12A and 12B show the CD transport unit 8 as it is mounted to the printing apparatus 1. As shown in FIGS. 12A and 12B, in the process of mounting, the CD transport unit 8 is first held toward the mounting portion 991 of the printing apparatus 1. Then, the CD transport unit 8 is moved straight in the direction of arrow Y and inserted into the opening of the mounting portion 991 formed in the lower case 99. At this time, engagement portions 822 at both sides of the tray guide 82 are inserted along guide rails 993 provided at both sides of the lower case 99 shown in FIG. 13. This allows the CD transport unit 8 to be positioned easily in the vertical and horizontal directions, assuring a smooth insertion of the unit. On both sides of the tray guide 82 there are pivotable hooks 84 (see FIGS. 14A and 14B) that are urged in a predetermined rotary direction. After the CD transport unit 8 is inserted to a predetermined position, it can no longer be advanced. At this point, the hooks 84 are activated by stoppers of the guide rails 993 to lock the inserted CD transport unit 8 from moving back. The platen 34 in the printing apparatus 1 is provided with a tray guide sensor (detection means) 344 of mechanical structure to detect when the tray guide 82 is mounted. When the tray guide 82 is inserted to an appropriate position in the mounting portion 991 of the printing apparatus 1, a part of the tray guide 82 presses the tray guide sensor 344 which then outputs a predetermined detection signal. Based on this detection signal, a decision is made as to whether the mounting condition is good or not.

In the mounting process described above, when the slide cover 81 is moved toward the printing apparatus 1, arms 85 interlocked with the slide cover 81 are projected toward the printing apparatus 1, as shown in FIG. 10B. Meanwhile, the spur holder 43 rotatably supporting the spurs 42 is supported vertically slidable on the platen 34 and urged downward by a predetermined force of a spring. Thus, as the arms 85 are inserted between the spur holder 43 and the platen 34, the spur holder 43 is pushed up a predetermined distance against the force of the spring.

This process is shown in FIG. 14A and FIG. 14B. FIG. 14A illustrates a state before the arms 85 are projected and FIG. 14B illustrates a state in which the arms 85 are projected to slide the spur holder 43 up. At this time, slope portions 851 formed at front ends of the arms 85 facilitate a smooth insertion of the arms 85 between the platen 34 and the spur holder 43. With the arms 85 inserted between the platen 34 and the spur holder 43, a space is formed between the platen 34 and the spur holder 43, large enough for the tray 83 to pass through. The arms 85, when inserted between the platen 34 and the spur holder 43, are held immovable at a predetermined position, whereas, when they are retracted in the tray guide 82, the arms 85 have some play with the tray guide 82.

In a state where the slide cover 81 is not moved toward the printing apparatus 1, the opening 821 shown in FIG. 12B is closed, so the tray 83 cannot be inserted. If in this state the slide cover 81 is pushed toward the printing apparatus 1, the slide cover 81 slides upward at an angle, exposing the opening 821 between it and the tray guide 82. Then, the tray 83 loaded with a CD can be inserted from the opening 821 and set at a predetermined position. At this time, the spur holder 43 is raised by the arms of the slide cover 81, thus eliminating the possibility that an interference between the inserted tray 83 and the spurs 42 may damage a tray seat 831 at the front end of the tray 83 or spurs 42.

Next, the process of dismounting the CD transport unit 8 from the printing apparatus 1 will be described.

As shown in FIG. 15, when the slide cover 81 of the tray guide 82 is pulled away from the printing apparatus 1, i.e., in a direction opposite the Y direction of FIGS. 12A and 12B, the arms 85 interlocked with the slide cover 81 are retracted from the spur holder 43, allowing the spur holder 43 and the spurs 42 to move down to their initial positions. At this time, if the tray 83 is left inserted in the printing apparatus 1, the tray 83 gets stuck in the opening 821 formed between the slide cover 81 and the tray guide 82, making it impossible to pull the slide cover 81 any further. This protects a CD remaining in the printing apparatus 1 from being damaged by the spurs 42 moving down. With the tray 83 taken out of the CD transport unit 8, withdrawing the slide cover 81 toward the initial retracted position causes the slide cover 81 to act on the hooks 84 in the process and release them from the guide rails 993 of the lower case 99, thus allowing the CD transport unit 8 to be dismounted from the apparatus.

Next, a construction of the tray 83 will be explained. The tray 83, as shown in FIG. 16, is formed of a resin plate about 2–3 mm thick and has a CD mounting portion 832, a grip portion 833 to be held by the user when loading or unloading the tray, position detection marks 834 (834*a*, 834*b*, 834*c*), CD pickup holes 835, insertion position alignment marks 836, a side pressure roller escape portion 837*b*, and a media presence/absence detection mark 838. Further, at the front end of the tray 83 a tray seat 831 is projected from the tray 83 in the transport direction to ensure a firm grip on the tray 83 by the transport roller 36 and the pinch rollers 37.

The tray seat 831 is bonded by a double-sided adhesive tape to a planar portion 83*a*, opposite the CD mounting surface, of an tapered portion 830 formed at the front end of the tray 83. The tray seat 831 is formed of a film thinner than the front end of the tray 83. For example, the tray seat 831 uses a PET about 0.1–0.3 mm thick as a base material, with one of its surfaces coated with a coating material to give it a desired frictional coefficient and hardness. In this embodiment in particular, the coating material is not a commonly used material, such as rubber and urethane, that easily adheres to a mating member but one having a predetermined surface roughness and a higher hardness than those of rubber and urethane. If rubber or urethane is used, when the tray seat 831 engages a member such as the paper guide flapper 33 of resin installed in the transport path of the tray 83, the coating material comes into intimate contact with the member, significantly increasing a transport load. To deal with this problem, a coating material with a predetermined surface roughness and a high level of hardness is chosen.

The coated surface is provided on that surface of the tray seat 831 which contacts the transport roller 36. This ensures that when the coated surface is in contact with the transport roller 36, a sufficient transport force to feed the tray 83 can be produced. The tray seat 831 is formed in an almost trapezoidal shape, as shown in FIG. 16, and is secured to the front end portion of the tray 83 so that its shorter side protrudes outwardly from the tray 83. In this embodiment, a distance A by which the tray seat 831 projects from the tray 83 in the transport direction is about 3 mm. The protruding distance A is such that, when the front end portion of the tray seat 831 reaches the nip portion between the transport roller 36 and the pinch rollers 37, the front end portion of the tray 83 does not touch the nip portion. That is, when the front end portion of the tray seat 831 is gripped by the nip portion, the gripping action of the nip portion is not interfered with by the front end portion of the tray 83.

The tray 83 itself has a tapered portion 830 at the front end. First, the tray seat 831 is gripped between the transport roller 36 and the pinch rollers 37 and this produces a tray transport force. The pinch rollers 37 are lifted along the tapered portion 830 attached at the front end of the tray 83 so that the relatively thick tray 83 can be held between the transport roller 36 and the pinch rollers 37 for transport.

The position detection marks 834 provided on the tray 83 comprise two position detection marks 834*a*, 834*b* formed on the front side of the CD mounting portion of the tray 83 and one position detection mark 834*c* on the opposite side. The position detection marks 834 in this embodiment are each formed of a highly reflective, square member 5 mm on each side. Here, a hot stamping is used to form the marks. Around each of these position detection marks 834 is formed a recessed portion 839 which can clearly define a range of reflected light from the resin position detection marks 834. That is, a bottom surface of each recessed portion 839 has a high planarity and is inclined at a predetermined angle with respect to the surface of the position detection marks 834, as shown in FIG. 17. Thus, if the light emitted from the tray position detection sensor 59 provided on the carriage 50 should be reflected outside the position detection marks 834, it can be prevented from returning to the sensor, thus eliminating erroneous detections.

As described above, since a light reflectivity of the position detection marks 834 on the tray 83 is high, there is no need to mount a high-performance sensor and correction processing can also be reduced, minimizing cost and printing time. Further, compared with a technique that directly reads an edge of a print area of a CD, this embodiment can perform a precise position detection even when printing on a colored CD or re-printing on a printed CD.

When a CD is to be mounted on the tray 83, a center hole of the CD is aligned with the CD mounting portion 832 as it is put on the tray. When the CD is to be removed, the user puts his or her fingers into the two CD pickup holes 835 to hold an outer circumferential edge of the CD. The CD mounting portion 832 is provided with a plurality of molded claws that act to position the CD as it is mounted and to also eliminate play. Further, the CD mounting portion 832 has a recessed surface lower than other areas of the tray 83 which is provided with a media presence/absence detection mark 838. The recessed surface is provided to form a hot stamp of a predetermined width with a hole of a predetermined width therein. It is decided that no media is present when the hole of a predetermined width is detected.

The position detection marks 834 are located between the pinch rollers 37 so that their surfaces will not be scored by the pinch rollers 37.

The tray 83 that was transported to a predetermined position can be taken out of the tray guide 82 by withdrawing it. Further, the user can hold the outer circumferential edge of the CD by inserting his fingers into two CD pickup holes 835 and remove it from the tray.

(Printing Operation)

Next, the process of printing on a print area on the surface of a CD by using the ink jet printing apparatus of the above construction will be described.

First, the CD transport unit 8 is slid straight toward the printing apparatus and mounted to the lower case 99. At this time, when the tray guide 82 is mounted to the printing apparatus 1, the tray guide sensor 344 detects it.

Then, moving the slide cover 81 toward the printing apparatus 1 causes the arms 85 interlocked with the slide cover 81 to project toward the apparatus. As the arms 85 advance between the spur holder 43 and the platen 34, they lift the spur holder 43 a predetermined distance.

As described above, when the slide cover 81 is moved toward the printing apparatus 1, the slide cover 81 slides upward at an angle to expose the opening 821 between it and the tray guide 82. Then a CD is placed on the CD mounting portion 832 of the tray 83. The user holds the grip portion 833 and inserts the CD-mounted tray 83 into the opening 821 until the position detection marks 834 align with a tray set mark 826 on the tray guide 82. The tray 83 thus set is shown in FIG. 18.

In this state, when a print signal is sent from a host, the apparatus starts printing. First, the transport roller 36 and the discharge rollers 40, 41 rotate in a reverse direction. Since the tray 83 is pressed under a predetermined pressure against the discharge rollers 40, 41 by the press rollers 811 through roll springs (not shown), the tray 83 is transported by the rotating force of the discharge rollers in the reverse direction, i.e., into the apparatus. Then, the tray seat 831 is gripped by the transport roller 36 and the pinch rollers 37 and now reliably moved by a predetermined transport force. The pinch rollers 37 then ride on the tapered portion 830 at the front end of the tray 83 so that the tray 83 is held between the transport roller 36 and the pinch rollers 37.

Next, the carriage 50 is moved from the home position to the print area to detect the tray 83. The lifting operation of the carriage 50 and the guide shaft 52 will be explained later. As shown in FIG. 8B, the carriage lift motor 58 is driven to raise the guide shaft 52 to form an optimum gap for the tray 83.

Figures 19A, 19B, 19C:
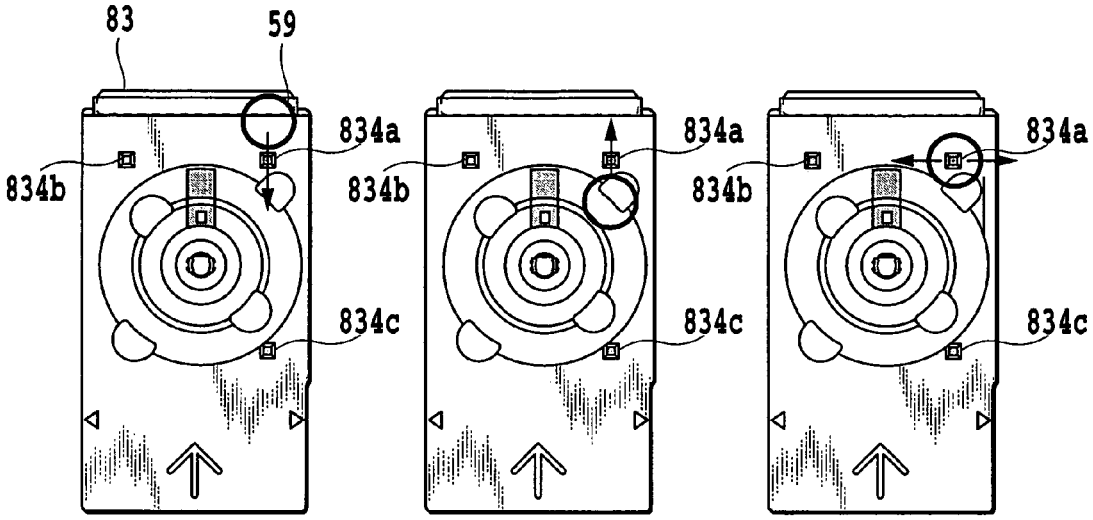
FIGS. 19A to 19F are explanatory plan views showing a positional relation between the tray and a position detection sensor in the first embodiment of the invention.

Next, as shown in FIGS. 19A and 19B, the carriage 50 is stopped at a position where its tray position detection sensor 59 aligns with the position detection mark 834*a* on the tray 83. Then, the tray 83 is transported and an edge on the upper side of the position detection mark 834*a* is detected (see FIG. 19A). The tray 83 is further transported until an edge on the lower side of the position detection mark 834*a* is detected (see FIG. 19B). Next, the tray 83 is moved back until the tray position detection sensor 59 comes at almost the center of the position detection mark 834*a*, and the carriage 50 is moved left and right to detect a right edge position and a left edge position of the position detection mark 834*a* (see FIG. 19C). Now, a center position 834*ac* of the position detection mark 834*a* can be calculated and, based on the center position 834*ac*, the print position of the CD placed on the tray 83 can be determined.

As described above, since this embodiment detects the position of the tray itself, print position variations resulting from parts precision variations and tray conditions can be reduced when compared with a technique that performs printing by depending solely on a mechanical precision and not performing a position detection.

Figures 19D, 19E, 19F:
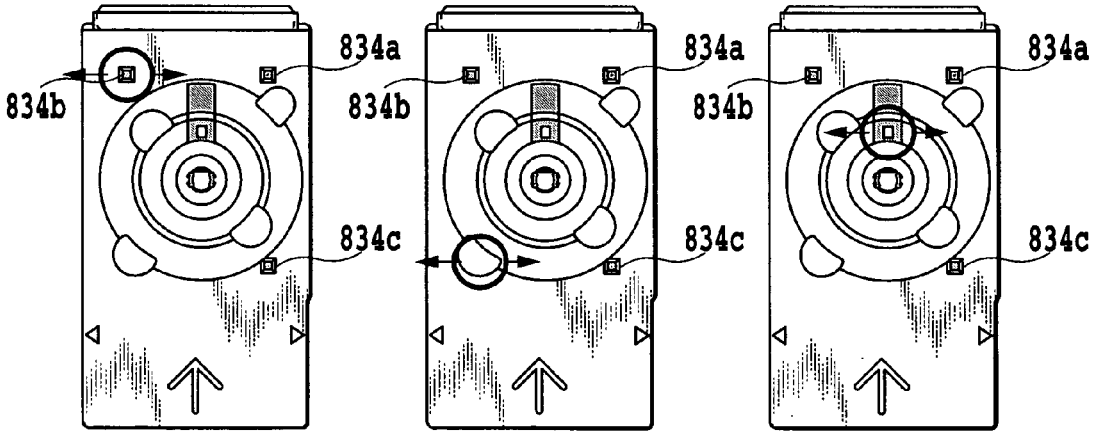

After detecting the position of the position detection mark 834*a*, the carriage 50 is moved to the position detection mark 834*b* to detect its position as shown in FIG. 19D. Detecting edges at both ends of the position detection mark 834*b* can confirm that the position of the position detection mark 834*a* detected earlier is correct. That is, if the tray 83 is set farther inwardly than the correct set position and the position detection mark 834*c* is detected, as shown in FIG. 19E, the process of moving the carriage 50 for finding the position detection mark 834*b* can determine that the position detection mark 834*c* found is not the position detection mark 834*a*.

If it is decided that the position detection mark found is not the position detection mark 834*a* but the position detection mark 834*c*, the tray 83 is transported to a position where the tray position detection sensor 59 faces the position detection mark 834*a* and then the search-and-detect operation for the position detection mark 834*a* is executed. At this time, if the position detection mark 834*a* is not found, this is interpreted as an error and the tray 83 is discharged.

After the position of the tray 83 has been detected, as shown in FIG. 19F, it is transported in the tray transport direction until the tray position detection sensor 59 of the carriage 50 aligns with the media presence/absence detection mark 838 on the tray 83. At this time, if the edge of the detection hole in the media presence/absence detection mark 838 is detected and the hole width matches a predetermined width, it is decided that a CD is not mounted, interrupting the printing operation, discharging the tray 83 to a predetermined position and indicating an error. If the media presence/absence detection mark 838 is not found, it is decided that a CD is loaded and the printing operation is proceeded.

With the above-mentioned series of initial operations completed, the tray 83 loaded with the CD that is set in the printing apparatus 1 is transported to a predetermined position for printing. Then, according to print data sent from the host, the printing operation is executed. In the printing operation, a multipass printing that forms an image with a plurality of scans is performed to minimize the occurrence of banding that results depending on a transport accuracy and dot landing precision of the head 7.

After the printing operation is finished, the tray 83 is transported back to the initial position, i.e., the position where the user placed the tray 83 on the tray guide 82 before the printing operation. In this state, the user can take out the CD-loaded tray 83 that has undergone the printing operation. Further, pulling the slide cover 81 forward can release the arms 85 from the spur holder 43, disengaging the hooks 84 from the lower case 99. Now, the CD transport unit 8 is unlocked from the printing apparatus 1 and can be dismounted.

(Control System)

Figure 20:
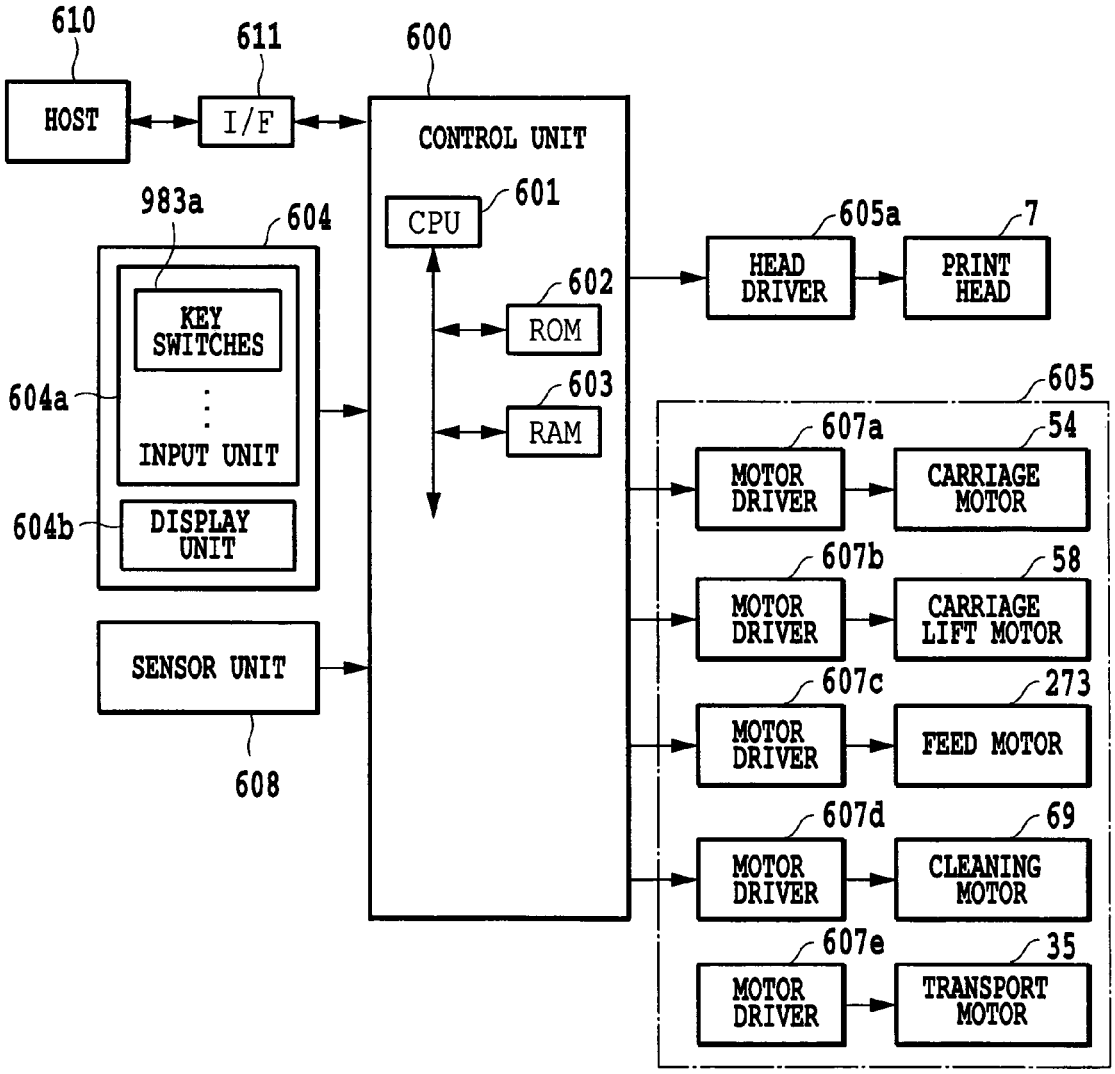
FIG. 20 is a block diagram showing an outline configuration of a control system in the first embodiment of the invention.

FIG. 20 shows an outline configuration of a control system of the ink jet printing apparatus of the above construction.

In the figure, reference number 600 represents a control unit that controls various components of the ink jet printing apparatus. This control unit has a CPU 601 that performs various calculations, controls and decisions, a ROM 602 that stores a control program and data, and a RAM 603 that temporarily stores data and functions as a work area used by the CPU 601 during calculations.

The control unit 600 is connected to a host computer 610 as an external device through an interface 611 and also to an operation panel 604, a head driver 605*a* to drive a heater in each nozzle of the print head, motor drivers 607*a*–607*e* for driving motors, and a sensor unit 608 made up of the above-described sensors to detect statuses of the apparatus and its various components.

The operation panel 604 has an input unit 604*a* with key switches, such as power key switch 983*a*, for issuing a variety of demands and performing data input and a display unit 604*b* for displaying statuses of the apparatus and components.

A drive unit 605 has a variety of motors, such as a paper supply motor 273 as a drive source for supplying paper, a carriage motor 54 for scanning the carriage 50, a transport motor 35 for driving the transport roller 36, a cleaning motor 69 for the cleaning operation and a carriage lift motor 58 for raising or lowering the carriage 50, and also has motor drivers 607*a*–607*e* for driving these motors.

According to data sent from external devices such as the host computer and signals from the sensors, the control unit 600 performs control on the drivers 607*a*–607*e* and others according to drive programs stored in the ROM 602 to execute a printing operation control (described later).

(Control Sequence for Printing Operation)

Next, a control sequence for the printing operation of the ink jet printing apparatus of the above construction will be described by referring to FIGS. 21A and 21B.

A first step to be performed after a power line of the ink jet printing apparatus is connected to an AC supply is to execute a first initialization of the apparatus at step S1. This initialization checks an electric circuit system, including ROM and RAM of the apparatus, to confirm that the apparatus is electrically normal. This first initialization does not execute processing on the drive mechanism of the printing apparatus 1.

Next, at step S2, it is checked whether the power key switch 983*a* on the upper case 98 is turned on. If the power key switch 983*a* is found to be pressed, the control moves to the next step S3 where it executes a second initialization.

In the second initialization at step S3, various drive mechanisms in the apparatus and the head system are checked. That is, this step performs initialization of motors and various mechanisms connected to the motors and checks, by reading head information, whether the apparatus is normally operable.

Next, at step S4, the control waits for a variety of events in the printing apparatus. That is, this step monitors an instruction event from an external interface, a panel key event from user operation and an internal control event, and executes processing according to the event. The panel key event from user operation includes a power off operation using the power key switch 983*a*, a head cleaning operation by a resume switch 983*b*, and a cancel of printing operation.

At step S4, when the control receives a print command event from an external I/F, it moves to step S5. When at step S4 a power key event from a user operation occurs, the control moves to step S200 where it terminates the printer operation. If at step S4 other events occur, it moves to step S300 and performs the associated event processing.

When, upon receipt of a print command as an event, the control moves to step S5, it analyzes the print command from the external I/F to determine a kind of paper, paper size, print quality and paper supply method specified. It then stores data representing these check results in the RAM of the apparatus before moving to step S511 of FIG. 21A.

In steps S511–S515, a check is made as to whether the printing apparatus 1 is in a state appropriate for the specified paper supply method. Step S511 checks if the print command specifies a printing operation that does not use the CD transport unit 8 or one that uses the CD transport unit 8. If it is decided that the print command specifies a printing operation not using the CD transport unit 8, the control moves to step S512 where it checks the detection result of the tray guide sensor (tray guide detection means) 344 shown in FIG. 13 to see whether the CD transport unit 8 is mounted to the printing apparatus 1. If it is found that the CD transport unit 8 is not mounted, the apparatus is in an appropriate state for the print command and thus the control selects an activation of an automatic sheet feeder 2 and moves to step S6 to start the paper feeding from ASF 2. If at step S512 the CD transport unit 8 is found to be mounted, the apparatus is in a state not suited for the print command and thus the control moves to step S515 where it annunciates an error state and enters into a wait state.

If step S511 decides that the print command specifies a printing operation that uses the CD transport unit 8, the control at the next step S513 checks if the CD transport unit 8 is mounted or not. When the CD transport unit 8 is found mounted, the apparatus is in an appropriate state for the received print command and thus the control moves to step S516 where it drives the carriage lift motor 58 to lift the carriage 50. Next, the control proceeds to step S6 where it executes the media transport operation from the CD transport unit 8. If at step S513 the CD transport unit 8 is found not mounted, the apparatus is not in an appropriate state for the print command and the control moves to step S514 where it annunciates an error state and enters into a wait state.

When the printing apparatus 1 is in an appropriate state for the print command, the control moves to step S6 where it starts a feed operation according to the specified feeding method to feed a print medium to the print start position. Then, the control moves to step S7 to execute the printing operation. In this printing operation, the print data sent from the interface 611 is temporarily stored in a print buffer. Next, the carriage motor 54 is driven to move the carriage 50 in the main scan direction and at the same time the print data stored in the print buffer is supplied to the print head 7 to start printing one line of data. After one line of print data is printed, the transport motor 35 is driven to rotate the transport roller 36 to feed the print medium in the subscan direction. Then, the above operation is repeated until one page of print data sent via the interface 611 is printed. The control then proceeds to step S8.

Step S8 drives the transport motor 35 to rotate the discharge rollers 40, 41 to feed the print medium until it is decided that the print medium is discharged completely out of the printing apparatus. When the discharge operation is finished, the print medium is discharged onto the discharge tray 46 or the tray guide 82 of the CD transport unit 8.

Next, at step S9 a check is made as to whether all the pages have been printed. If there are pages that need to be printed, the control returns to step S5 and repeats the sequence of operations from step S5 to step S9 until the printing of all the pages is finished, at which time the control moves to step S4 where it waits for the next event.

(Control Sequence for Head/Tank Replacement)

Next, a control for mounting and removing the print head 7 and ink tank 71 to and from the carriage 50 will be explained.

In this embodiment, the mounting and dismounting of the print head 7 and the ink tank 71 is performed by pivoting open the access cover 97 shown in FIG. 1. That is, opening the access cover 97 causes the carriage 50 to move to a position corresponding to the upper case opening 984 shown in FIG. 9, where it is exposed outside. The print head 7 and the ink tank 71 can now be mounted or replaced. When the access cover 97 is opened, a door switch lever 981 outputs a detection signal to the control unit 600 which, according to the detection signal, controls the movement of the carriage 50. FIG. 9 shows the carriage 50 already moved to the position (head/tank replacement position) where the print head 7 and ink tank 71 can be mounted or replaced. The head/tank replacement position is a position where the ink ejection portion 701 of the print head 7 mounted on the carriage 50 opposes the tray 83 transported from the CD transport unit 8.

When at step S4 of FIG. 21A the opening action of the access cover 97 is detected, cover opening processing from step S100 to step S109 is initiated. First, at step S100, it is checked whether the CD transport unit 8 is mounted. If the CD transport unit 8 is not mounted, the control moves to step S101 where it drives the carriage motor 54 to move the carriage 50 to the head/tank replacement position. Then at step S102 the carriage 50 is made to stand by. In this state, the user can perform the mounting or replacement of the print head 7 and the ink tank 71.

Next, at step S103, the open/closed state of the access cover 97 is monitored. When, after the head/tank has been removed and replaced, the user closes the access cover 97, this closing action is detected and the control moves to step S104. Step S104 checks whether the print head 7 is mounted on the carriage 50. If it is found that the print head 7 is not mounted, an error is annunciated indicating that the print head 7 is not mounted. If at step S104 it is decided that the print head 7 is mounted, the control moves to step S105 where it checks whether the ink tank 71 is replaced or not.

Whether the ink tank 71 has been replaced or not is determined by an ink tank sensor 47 on the spur holder 43 of FIG. 3 and FIG. 4 checking the ink volume in the ink tank. Then, when at step S105 the ink tank is found not replaced, this is indicated as an error state. If at step S105 the ink tank 71 is found to have been replaced, the control proceeds to step S106 to drive the cleaning unit 6 to execute the cleaning operation on the print head 7. Now, the cover opening processing is ended.

If at step S100 the CD transport unit 8 is found to be mounted, the control moves to step S107 and causes the carriage 50 to stand by, rather than moving to the head/tank replacement position. At this time, the carriage 50 stands by at a position facing the cap 61 of the cleaning unit 6. After this, the control moves to step S108 where it annunciates an error indicating that the carriage 50 is kept from moving to the head/tank replacement position. After this error annunciation, step S109 monitors the open/closed state of the access cover 97. If the access cover 97 is closed, the carriage 50 is left standing by. When at step S109 the closing of the access cover 97 is detected, the control returns to step S4 where it waits for another event. If, after the closing of the access cover 97 has been detected at step S109, the user removes the CD transport unit 8 from the printing apparatus and opens the access cover 97 again, the control moves to step S101 where it moves the carriage 50 to the head/tank replacement position. So the user can immediately start the mounting and replacement of the print head 7 and ink tank 71.

At step S200 shown in FIG. 21A, the printing operation end processing is executed to stop the operation of the printing apparatus. In this processing, the motors and print head are brought to a state where power can be turned off before actually cutting off the power. The control then moves to step S4 and waits for another event.

At step S300 events other than the above are processed. For example, step S300 performs operations associated with a print head cleaning command sent from panel keys on the operation panel 604 or from the host computer 610 via the interface 611 and operations associated with a cleaning command that is generated internally in the printing apparatus 1. After the processing is over, the control moves to step S4 where it waits for another event.

As described above, since in this embodiment the operation of the carriage 50 is controlled according to whether or not the CD transport unit 8 is mounted to the printing apparatus 1, there is no possibility that the replacement of the print head 7 and ink tank 71 may be performed inadvertently when the CD transport unit 8 is mounted and the tray 83 loaded, thus preventing a problem that the tray 83 or CD may get smeared with ink of the carriage 50. Therefore, the opening in the upper cover through which the print head 7 and the ink tank 71 are mounted or replaced can be formed in a central part of the upper case which overlaps the transport path of a print medium. This in turn ensures that the upper case 98 can have a sufficient strength and rigidity, leading to a reduced size of the apparatus.

Further, since a sensor for detecting the insertion of the tray 83 into the printing apparatus is not provided and since a tray guide sensor 344 is used to detect the mounting of the CD transport unit 8 loaded with the tray 83 and the operation of the carriage 50 is controlled according to the result of detection, the sensor can be constructed inexpensively in a small size.

SECOND EMBODIMENT

Figure 21B:
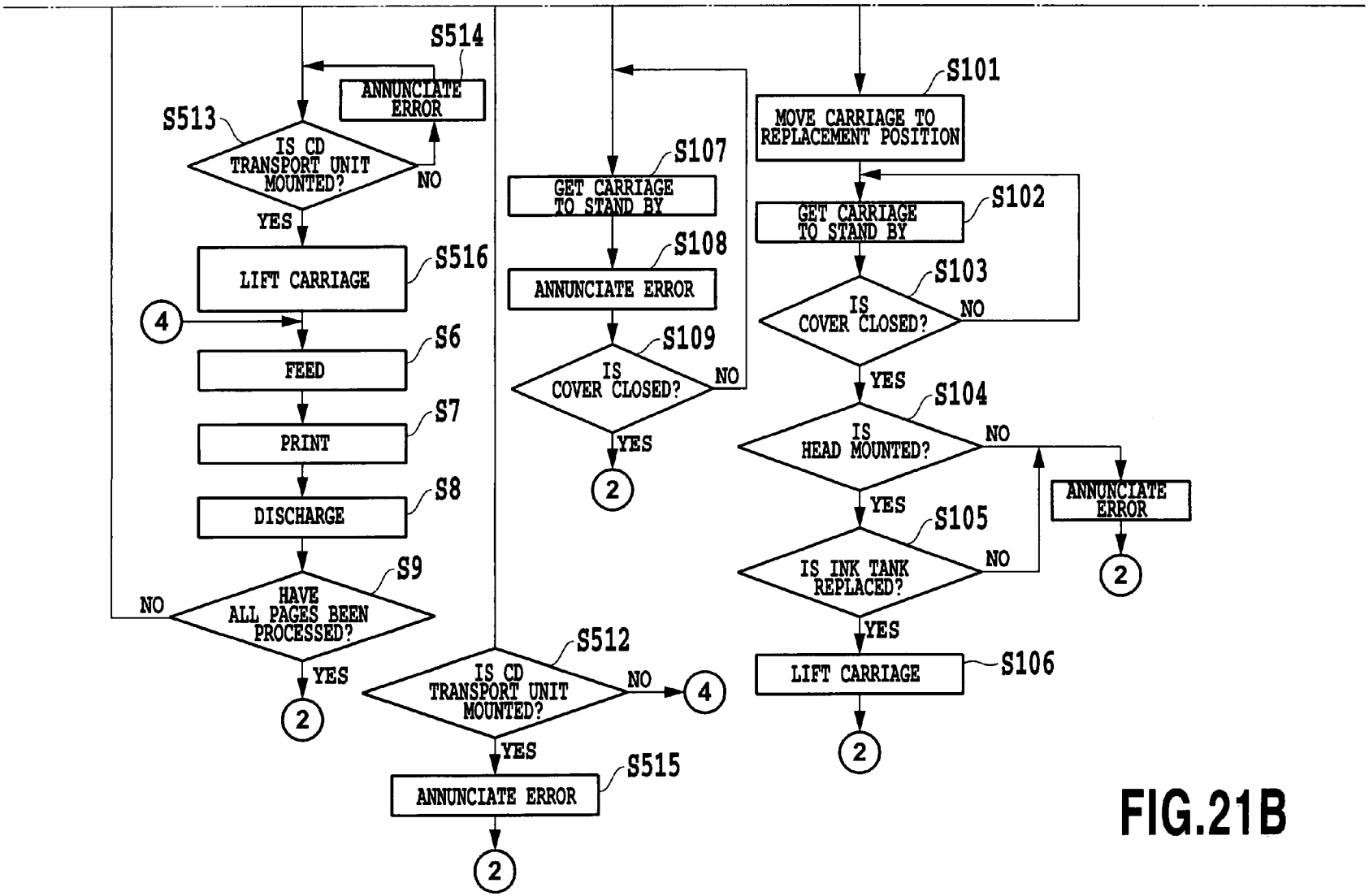
Figure 22B:
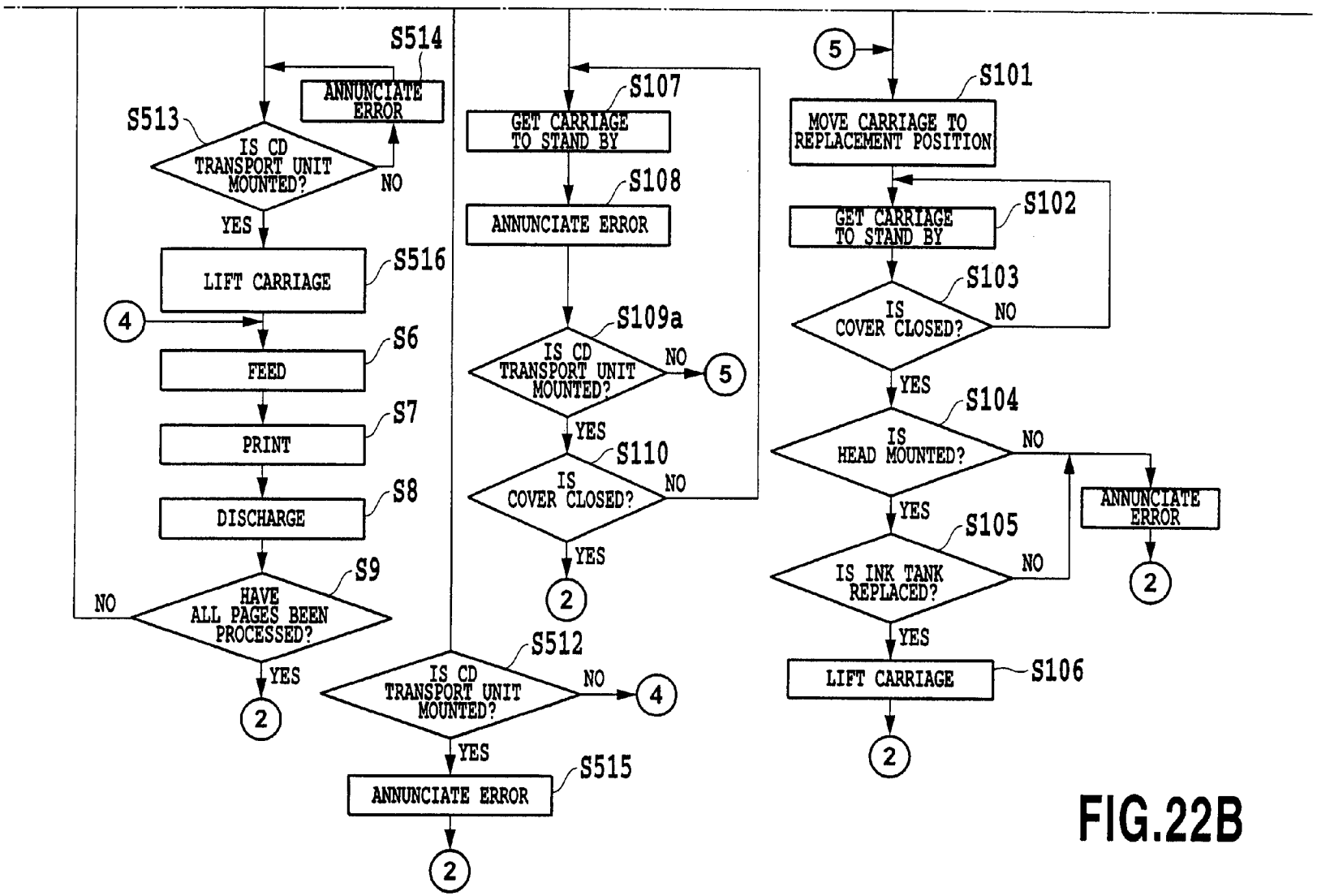

In the first embodiment described above, when the access cover 97 is opened, with the CD transport unit 8 mounted, it is annunciated at step S108 of FIG. 21B that the carriage 50 is not moved from the home position and then at step S109 the control waits for the access cover 97 to be closed. In the second embodiment of this invention, in step S109*a* of FIG. 22B following step S108, the mounting state of the CD transport unit 8 is monitored and, when the CD transport unit 8 is dismounted, the control, rather than waiting for the access cover 97 to be closed, immediately moves to step S101 where it moves the carriage 50 to the head/tank replacement position. If the CD transport unit is mounted, the control moves to step S110, which is similar to step S109 in FIG. 21B. With this configuration, simply removing the CD transport unit 8 allows the print head 7 and ink tank 71 to be mounted or replaced, improving the efficiency of the work.

THIRD EMBODIMENT

In the first and second embodiments, an example case has been described in which the operation of the carriage 50 is controlled during the process of mounting or replacing the print head 7 and ink tank 71. The control of the operation of the carriage 50 is not limited to the mounting/dismounting and replacement operations, but can also be executed in other situations. In the third embodiment of this invention described below, the operation of the carriage 50 is controlled during the process of cleaning the print head 7 with the CD transport unit 8 mounted.

Figure 23B:
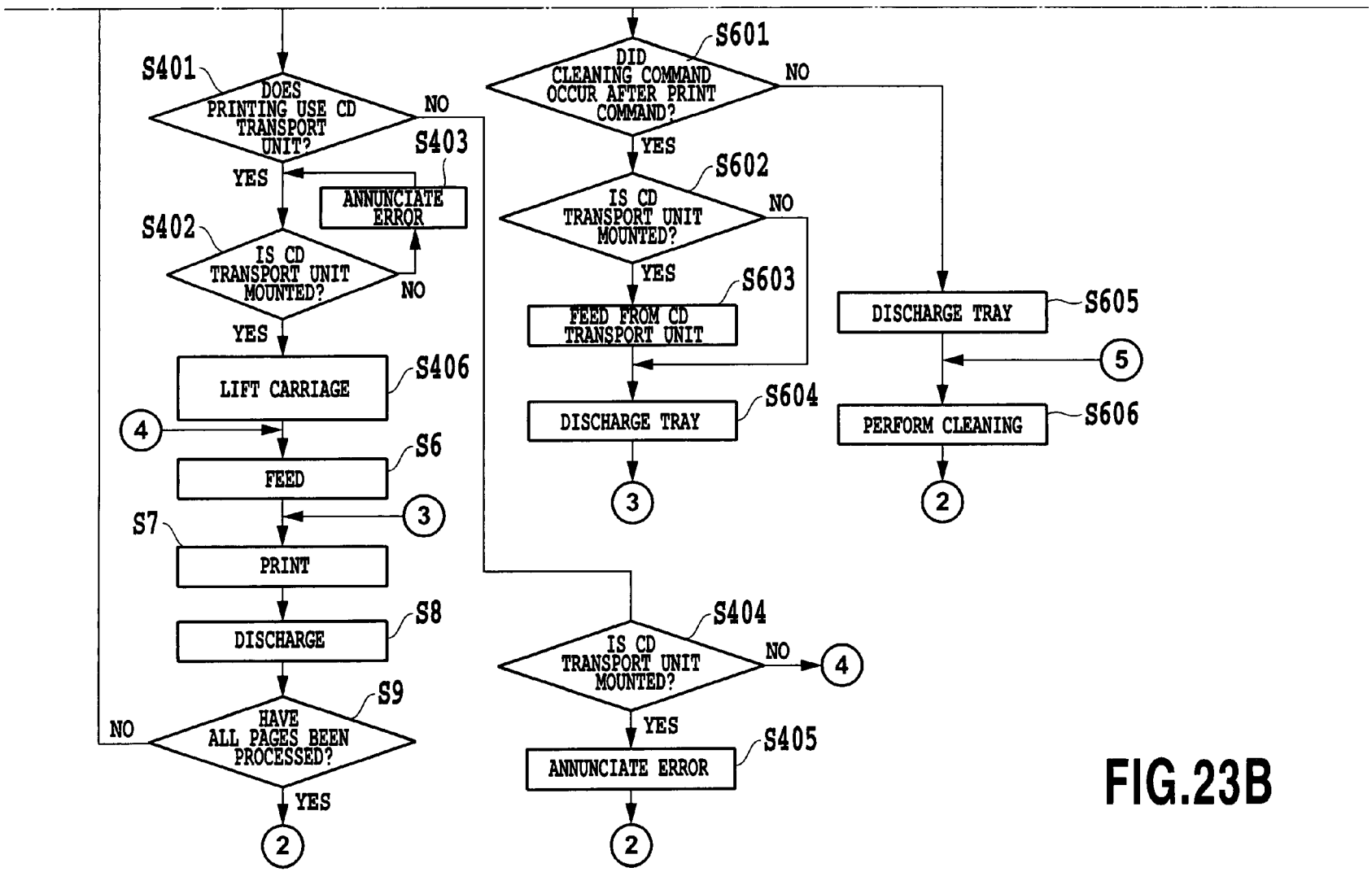

Referring to FIGS. 23A and 23B, the operation control on the carriage 50 in the third embodiment of the invention will be explained. In this third embodiment, too, the apparatus has the similar construction to that shown in FIGS. 1 to 20.

In the third embodiment, the head cleaning operation is initiated in the following three cases: (1) when the user operates the resume switch 983*b* on the upper case 98, (2) when the user manually specifies the cleaning operation via a printer driver, and (3) when the elapsed time counted from the previous cleaning operation exceeds a predetermined length of time, automatically initiating the cleaning operation. In this embodiment, the automatic cleaning operation is executed after a print command is received by the printing apparatus 1. Further, when the cleaning operation to render the ink ejection portion 701 of the print head 7 suitable for ink ejection, such as ink suction from the print head 7 and preliminary ejection of ink, is performed, an ink volume detection is executed to check an amount of ink in the ink tank 71. For the ink volume detection, the carriage 50 is moved to where it opposes the ink tank sensor 47 shown in FIG. 3 and FIG. 4.

In FIGS. 23A and 23B, the steps S1 to S4, the steps S6 to S9 and the printing operation end processing S200 are similar to those described in the preceding embodiments and thus their explanations are omitted here.

In the third embodiment, when a print command is received at step S5, it is checked at step S400 whether the automatic cleaning operation is necessary. If it is decided that the automatic cleaning operation is not necessary, the control moves to steps S401–S406 and S6–S9 where it performs processing similar to that represented by the steps S511–S516 and S6–S9 of FIGS. 21A to 22B.

If in step S400 the automatic cleaning operation is found necessary, the control moves to step S601 to see if the cleaning operation is demanded after a print command. In this example, the cleaning operation is an automatic cleaning operation, so that step S601 determines that the cleaning operation demand occurred after a print command and the control moves to step S602. Step S602 checks if the CD transport unit 8 is mounted on the printing apparatus. If the CD transport unit 8 is found mounted, the next step S603 feeds the tray 83. In this feeding operation, if the tray 83 is loaded on the CD transport unit 8, the tray 83 is transported to a position where the tapered portion 830 at the front end of the tray 83 can be held between the transport roller 36 and the pinch rollers 37. Then at the next step S604 the predetermined cleaning operation is performed on the print head 7. With the cleaning operation, such as ink suction from the print head 7, completed, the carriage 50 moves to a position where it faces the ink tank sensor 47 to check the ink volume in the ink tank 71. Then, the control proceeds to step S7 to start the printing operation.

If at step S602 the CD transport unit 8 is found not mounted, the feeding operation is not executed even if the cleaning operation demand occurs after a print command, and immediately the cleaning operation is performed at step S604. After this, the control moves to step S7 and the printing operation is started.

If at step S4 the cleaning operation is performed directly or manually by the user operation, the control moves to step S600 where it monitors the mounting state of the CD transport unit 8. If the CD transport unit 8 is not mounted, the feeding operation is not executed and immediately at step S606 the cleaning operation is performed.

If at step S600 the CD transport unit 8 is found mounted, the control moves to step 8601. Since the cleaning operation is not the one that follows a print command, the control moves to step S605 where it drives the transport motor 35 to discharge the tray 83, i.e., transport the tray 83 in a direction opposite the feeding direction so that the tray 83 is not inserted in the printing apparatus 1. After the cleaning operation has been done at step S606, the control returns to step S4 where it waits for another event.

As described above, if a cleaning operation is demanded when the CD transport unit 8 is not mounted, this embodiment executes the cleaning operation without performing the print medium feeding or discharging operation. If the cleaning operation is not demanded, the control waits for the next event.

If the CD transport unit 8 is mounted and the cleaning operation is to be executed automatically after a print command is received, this embodiment executes the cleaning operation after performing the print medium feeding operation. If the cleaning operation is not the one that is to be performed after a print command, it is executed after the discharging operation is done.

As described above, if the automatic cleaning operation is demanded after a print command has been received and if the CD transport unit 8 is mounted, the cleaning operation is performed with the front end portion of the tray 83 held between the transport roller 36 and the pinch rollers 37. Holding the tray including its front end portion between the transport roller 36 and the pinch rollers 37 causes the front end portion of the tray to be floated above the platen 34, so that even if the tray 83 is very close to the carriage 50, it is kept out of contact with the carriage 50 as the carriage 50 is moved for the cleaning operation. Therefore, a high reliability for cleaning is assured.

Further, in this embodiment since the tray discharge operation is not performed prior to the printing operation, there is no need to take a troublesome step of setting the tray 83 again before executing the printing operation. Thus the printing operation using the CD transport unit 8 can be done efficiently.

While in the above embodiments an example case has been explained in which the ink tank and the print head are removably supported on the carriage, this invention is also applicable to a configuration in which only one of the ink tank and the print head is removably mounted on the carriage.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for printing on a print medium with a print head, comprising:

a tray on which to place the print medium;

a tray guide removably mounted to the printing apparatus to support said tray so that said tray can be fed;

a detecting portion for detecting whether or not said tray guide is mounted to the printing apparatus;

a carriage that moves with the print head mounted thereon; and control means for prohibiting said carriage from moving to a replacing position for attaching or detaching the print head or an ink tank for supplying ink to the print head, when said detecting portion detects that said tray guide is mounted to the printing apparatus.

2. A printing apparatus as claimed in claim 1, wherein the replacing position is arranged at a position overlying a feeding path of the print medium.

3. A printing apparatus as claimed in claim 1, further comprising a cover member which rotates to expose the carriage to the exterior, wherein opening of said cover member causes the carriage to move to the replacing position.

4. A printing apparatus as claimed in claim 3, wherein an error alarm occurs when said control means prohibits the movement of the carriage independently from the opening of said cover member.

5. A printing apparatus as claimed in claim 4, wherein following the error alarm, closing of said cover member, detachment of said tray guide from the printing apparatus and re-opening of said cover member, said carriage moves to the replacing position.

6. A printing method for printing on a print medium with a print head, comprising the steps of:

removably mounting to a printing apparatus a tray guide that supports a tray on which the print medium is placed so that the tray can be fed;

detecting whether or not the tray guide is mounted to the printing apparatus by a detecting portion; and prohibiting a carriage from moving to a replacing position for attaching or detaching the print head or an ink tank for feeding ink to the print head when the detecting portion detects that the tray guide is mounted to the printing apparatus.

* * * * *